US008038272B2

(12) United States Patent
Okazaki

(10) Patent No.: US 8,038,272 B2
(45) Date of Patent: Oct. 18, 2011

(54) LIQUID-DROPLET JETTING APPARATUS

(75) Inventor: Naoya Okazaki, Gifu (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 303 days.

(21) Appl. No.: 12/284,261

(22) Filed: Sep. 19, 2008

(65) Prior Publication Data

US 2009/0079798 A1 Mar. 26, 2009

(30) Foreign Application Priority Data

Sep. 21, 2007 (JP) ..... 2007-246086
Sep. 21, 2007 (JP) ..... 2007-246087

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85

See application file for complete search history.

(56) References Cited

U.S. PATENT DOCUMENTS

2005/0122380 A1* 6/2005 Nakamura et al. ..... 347/65
2005/0206691 A1* 9/2005 Takata et al. ..... 347/84
2007/0120888 A1* 5/2007 Takata ..... 347/43
2007/0188565 A1* 8/2007 Shimizu et al. ..... 347/85
2007/0216738 A1* 9/2007 Shimizu et al. ..... 347/85

FOREIGN PATENT DOCUMENTS

JP 2005-262723 9/2005
JP 2005-280028 10/2005

* cited by examiner

*Primary Examiner* — Ryan Lepisto
(74) *Attorney, Agent, or Firm* — Frommer Lawrence & Haug LLP

(57) ABSTRACT

An ink storage chamber has a middle wall and a damper wall, which are in parallel to a flow direction of ink and which face each other vertically with a distance therebetween, and a surrounding wall surrounding a circumference of a space between the middle wall and the damper wall. On the middle wall, there is formed a pair of flow regulating ribs projecting toward the damper wall and extending substantially in parallel to the flow direction in a state of having a distance from the damper wall. A space sandwiched by the pair of flow regulating ribs is a main flow region, and spaces between the flow regulating ribs and the surrounding wall is sub-flow regions. A distance between the middle wall and the damper wall in the sub-flow regions is smaller than that in the main flow region. Accordingly, a wasted ink amount during purging can be reduced.

12 Claims, 16 Drawing Sheets

LIQUID-DROPLET JETTING APPARATUS

CROSS-REFERENCE TO RELATED APPLICATIONS

This application claims priority from Japanese Patent Applications No. 2007-246086 filed on Sep. 21, 2007, and No. 2007-246087 filed on Sep. 21, 2007, the disclosures of which are incorporated herein by reference in its entirety.

BACKGROUND OF THE INVENTION

1. Field of the Invention

The present invention relates to a liquid-droplet jetting apparatus such as an ink-jet printer.

2. Description of the Related Art

Conventionally, there is known an ink-jet printer having an ink-jet head with a plurality of nozzles for jetting ink droplets, and an ink storage chamber for temporarily storing ink to be supplied to the ink-jet head from an ink cartridge, in which a part of a wall defining the ink storage chamber is formed of a flexible film which absorbs pressure fluctuation of ink (see Japanese Patent Application Laid-open No. 2005-262723).

To absorb the pressure fluctuation of ink adequately by this flexible film, it is necessary that a large area of the flexible film is assured. However, when the area of the flexible film is made large, a channel cross-sectional area of the ink storage chamber becomes large, and hence partial stagnation may be generated in the flow of ink. Accordingly, in the ink-jet printer disclosed in Japanese Patent Application Laid-open No. 2005-262723, a pair of flow regulating ribs is provided so as to guide the ink to flow smoothly from an ink inlet port to an ink outlet port of the ink storage chamber.

Further, in the ink-jet printer described in Japanese Patent Application Laid-open No. 2005-262723, the attached ink cartridge and the ink storage chamber are communicated with a tube.

As described above, the part of the wall defining the ink storage chamber of this ink-jet printer is formed with a flexible film that absorbs pressure fluctuation of ink. Therefore, when the ink-cartridge is attached to a cartridge attaching part of the printer main body, an attaching pressure thereof is absorbed by elasticity of the flexible film, when it is transmitted to the storage chamber. The smaller the area of the flexible film is, the shorter the release time required for completely absorbing this attaching pressure becomes.

SUMMARY OF THE INVENTION

When the flow regulating ribs are arranged in the ink storage chamber, spaces are formed outside the flow regulating ribs. Thus, when air is mixed in the ink flowing in from the ink inlet port, the air may remain outside the flow regulating ribs. This remaining air may flow out to the ink outlet port at one burst by any kind of chance. Accordingly, there arises a need to assume the maximum amount of air remaining outside the flow regulating ribs and provide a large air trap chamber so that the maximum amount of air can be captured. In this manner, in a purge operation to discharge ink from the nozzles of the ink-jet head as maintenance, the ink discharging amount is set so as to discharge all the capacity of the air trap chamber, which hence results in increase of the wasted ink amount.

Further, it is desirable that the flexible film is set to have a large area for adequately absorbing a dynamic pressure accompanying acceleration/deceleration when a carriage on which the ink-jet head is mounted is scanned leftward and rightward reciprocally. When the area of the flexible film is made larger in response to such a request, the volume of the ink storage chamber also becomes large accordingly, and the release time for the attaching pressure of the ink cartridge becomes long. That is, the time for the attaching pressure propagated to the ink storage chamber to be bounced and returned to the cartridge attaching part becomes long. It is assumed that when the user attaches an ink cartridge to the cartridge attaching part of the printer main body, the user attaches a different ink cartridge to the cartridge attaching part by mistake. When the user removes the ink cartridge immediately thereafter, the attaching pressure returns to the ink inlet portion after the ink cartridge is removed. Therefore, the ink drips from the ink inlet portion.

Accordingly, an object of the present invention is to reduce the wasted ink amount when purging while allowing ink to flow smoothly in an ink storage chamber.

Further, another object of the present invention is to prevent dripping of liquid from a liquid inlet portion when a cartridge is attached to a cartridge attaching part and is removed immediately, while assuring absorbing performance for dynamic pressure accompanying acceleration/deceleration of a carriage.

According to an aspect of the invention, there is provided a liquid-droplet jetting apparatus which jets droplets of a liquid including:

a liquid supply source supplying the liquid;

a liquid-droplet jetting head having a plurality of nozzles; and a liquid storage chamber storing the liquid supplied from the liquid supply source and including a liquid inlet port through which the liquid supplied from the liquid supply source flows in, a liquid outlet port through which liquid flows out to the liquid-droplet jetting head, a pair of walls substantially in parallel to a flow direction of the liquid from the liquid inlet port toward the liquid outlet port and facing each other vertically with a distance therebetween, and a surrounding wall surrounding a circumference of a space between the pair of walls, wherein one wall of the pair of walls is a damper wall having flexibility, and the other wall of the pair of walls defines a main flow region and sub-flow regions, the main flow region in which the liquid flows from the liquid inlet port to the liquid outlet port and which extends substantially in parallel to the flow direction and the sub-flow regions being sandwiched by the main flow region and the surrounding wall on both sides of the flow direction of the main flow region and being formed higher toward the one wall than the main flow region.

According to the aspect of the invention, since the main flow region deeper than the sub-flow regions is formed along the flow direction in the liquid storage chamber, the flow of ink from the liquid inlet port to the liquid outlet port can be made smooth. Further, in the sub-flow regions, volumes are made small by forming a small distance between the pair of walls. Accordingly, when air flows in from the liquid inlet port, the amount of air remaining in the sub-regions is reduced. Thus, a wasted ink amount in a purge operation to discharge liquid from the nozzles of the liquid-droplet jetting head for maintenance can be reduced. Further, in the sub-flow regions, channel cross-sectional areas are small by forming a small distance between the pair of walls. Accordingly, flow rates in the sub-flow regions are accelerated. Therefore, even when a wrong kind of liquid is supplied to the liquid storage chamber, the liquid remaining in the sub-flow regions can be discharged smoothly by the purge operation, and thereby it becomes possible to recover quickly from a state that different kinds of liquid are mixed.

In the liquid-droplet jetting apparatus according to the present invention, the damper wall may be formed of a resin film adhered on the surrounding wall; and a distance between the other wall and the damper wall in the sub-flow regions may be larger in a vicinity of the surrounding wall than in a vicinity of borders between the main flow region and the sub-flow regions.

In this case, when the damper wall constructed of a resin film is adhered on the surrounding wall, if a small molten mass of the resin film drips on the sub-flow regions it does not easily reach the other wall. Therefore, it is prevented that the molten mass of the resin film is connected to the other wall to make the vibration possible area of the damper wall small, and thereby decrease of pressure fluctuation absorbing performance of the damper wall can be prevented.

In the liquid-droplet jetting apparatus according to the present invention, a pair of flow regulating ribs projecting toward the damper wall from the other wall and extending in parallel to the flow direction may be formed on the borders between the main flow region and the sub-flow regions.

In this case, independence between the main flow region and the sub-flow regions becomes high by sectioning the main flow region and the sub-flow regions by the flow regulating ribs, and it becomes possible to facilitate smooth flowing of liquid in the main flow region.

In the liquid-droplet jetting apparatus according to the present invention, a surface of the other wall in the sub-flow regions facing the damper wall may incline so that a distance between the surface of the other wall and the damper wall is increased gradually from the borders between the main flow region and the sub-flow regions toward the surrounding wall.

In this case, the volumes of the sub-flow regions can be made as small as possible while preventing a molten mass of the resin film from reaching the other wall.

In the liquid-droplet jetting apparatus according to the present invention, a distance between the damper wall and a surface, of each of the flow regulating ribs, facing the damper wall may be shorter than a distance between the damper wall and a surface of the other wall facing the damper wall in the vicinity of the surrounding wall in the sub-flow regions.

In this case, when the resin film is adhered on the surrounding wall, if a small molten mass of the resin film drips on the sub-flow regions it does not easily reach the other wall. Therefore, it is prevented that the molten mass of the resin film is connected to the other wall to make the vibration possible area of the damper wall small, and thereby decrease of pressure fluctuation absorbing performance of the damper wall can be prevented.

In the liquid-droplet jetting apparatus according to the present invention, the liquid supply source may have a liquid storage chamber and a liquid outlet portion;

the liquid-droplet jetting apparatus may further comprise an attaching part which has a liquid inlet portion coupled to the liquid outlet portion of the liquid supply source, and to which the liquid supply source is attached detachably, and a communication channel communicating the liquid inlet portion and the liquid storage chamber; and the surrounding wall may have a substantially rectangular shape in which one of corners is chamfered.

In this case, corner portions of the surrounding wall in a substantially rectangular shape in plan view are positions where it is more difficult for the damper wall to deform as compared to the other portions, and have dynamic pressure absorbing performance that is originally poor. By removing them to reduce the area of the damper wall, the volume of the liquid storage chamber can be reduced while keeping the dynamic pressure absorbing performance as much as possible. Accordingly, the time required for releasing an attaching pressure of the liquid supply source (liquid cartridge) can be shortened. Therefore, even when the liquid cartridge is removed from the (cartridge) attaching part just after attaching, dripping of liquid from the liquid inlet portion of the (cartridge) attaching part can be prevented. Note that the communication channel which allows the liquid inlet portion to communicate with the liquid storage chamber is satisfactory as long as it allows the communication at least when the liquid cartridge is attached to the (cartridge) attaching part, but it may allow the communication all the time.

In the liquid-droplet jetting apparatus according to the present invention, the other wall may have a pair of flow regulating ribs projecting toward the damper wall and extending substantially in parallel to the flow direction with a distance from the damper wall, and arranged on borders between the main flow region and the sub-flow regions; and the surrounding wall may have a shape in which corner portions corresponding to the sub regions are chamfered In this case, since the corner portions corresponding to the sub-flow regions are removed from the surrounding wall, the volumes of the sub-flow regions become small. When air flows in from the liquid inlet port, the amount of air to remain in the sub-flow regions is reduced. Therefore, a wasted ink amount required for discharging air can be reduced when purging for discharging liquid from the nozzles of the liquid-droplet jetting head for maintenance.

In the liquid-droplet jetting apparatus according to the present invention, the damper wall may be formed by adhering a resin film of a rectangular shape on the surrounding wall.

According to the above structure, the resin film can be adhered in a rectangular shape as it is on the surrounding wall, which is a state of being cut by a film cutter from a roll of the resin film. Then processing after cutting is unnecessary, and increase of manufacturing steps can be prevented.

In the liquid-droplet jetting apparatus according to the present invention, the liquid storage chamber may be arranged at a position higher than the liquid inlet portion of the attaching part.

In this case, by waterhead pressure of the liquid in the liquid storage chamber, a pressure is applied to the liquid in the liquid inlet portion of the cartridge attaching part via the communication channel, and the liquid can easily drip to the outside from the liquid inlet portion. However, as described above, since the time required for releasing the attaching pressure of the liquid cartridge is short, dripping of the liquid from the liquid inlet portion of the cartridge attaching part can be prevented more favorably.

In the liquid-droplet jetting apparatus according to the present invention, the damper wall may be formed of a material selected from a group consisting of polyethylene terephthalate, nylon, and polypropylene. In this case, a damper wall having sufficient flexibility can be formed easily. Note that these materials may be used as a single sheet or a plurality of sheets thereof may be stacked and used.

In the liquid-droplet jetting apparatus according to the present invention, gaps may be defined between the surrounding wall and both ends of the flow regulating ribs in the flow direction. For example, when inks are used as the liquid, it is possible that colors of the inks are mixed (color mixing). In this case, all the inks in the liquid storage chamber including liquid which entered the sub-flow regions need to be discharged and replaced with new inks. In such a case, the ink which entered the sub-flow regions in the liquid storage chamber can be discharged easily through the gaps.

In the liquid-droplet jetting apparatus according to the present invention, the liquid storage chamber may be formed as a plurality of individual liquid storage chambers stacked vertically, and color inks may be stored as the liquid in the individual liquid storage chambers respectively, the color inks not being a black ink. In this case, since the individual liquid storage chambers are stacked and arranged vertically, the entire liquid storage chamber can be formed small. Further, the above-explained color mixing becomes a problem regarding color inks, but even when the color mixing occurs, the color inks in the individual liquid storage chambers can be discharged easily.

As is clear from the above explanation, according to the present invention, while providing a structure in which ink can flow smoothly from the liquid inlet port to the liquid outlet port, a wasted ink amount in a purge operation to discharge liquid from the nozzles of the liquid-droplet jetting head for maintenance can be reduced. Further, even when a wrong kind of liquid is supplied to the liquid storage chamber, the liquid remaining in the sub-flow regions can be discharged smoothly by the purge operation, and it becomes possible to recover quickly from a state that different kinds of liquid are mixed.

Further, as is clear from the above explanation, according to the present invention, while assuring absorbing performance for dynamic pressure of the liquid storage chamber, time required for releasing an attaching pressure of the liquid cartridge can be shortened. Thus, it is possible to provide a high quality liquid-droplet jetting apparatus in which the dynamic pressure absorbing performance and prevention of dripping of liquid from the liquid inlet portion when the liquid cartridge is removed just after being attached are both realized.

DETAILED DESCRIPTION OF THE PREFERRED EMBODIMENTS

Hereinafter, embodiments according to the present invention will be explained with reference to the drawings. Note that in the explanation below, the direction of jetting an ink from an ink-jet head is regarded as a lower side, and a direction opposite thereto is regarded as an upper side.

First Embodiment

Figure 1:
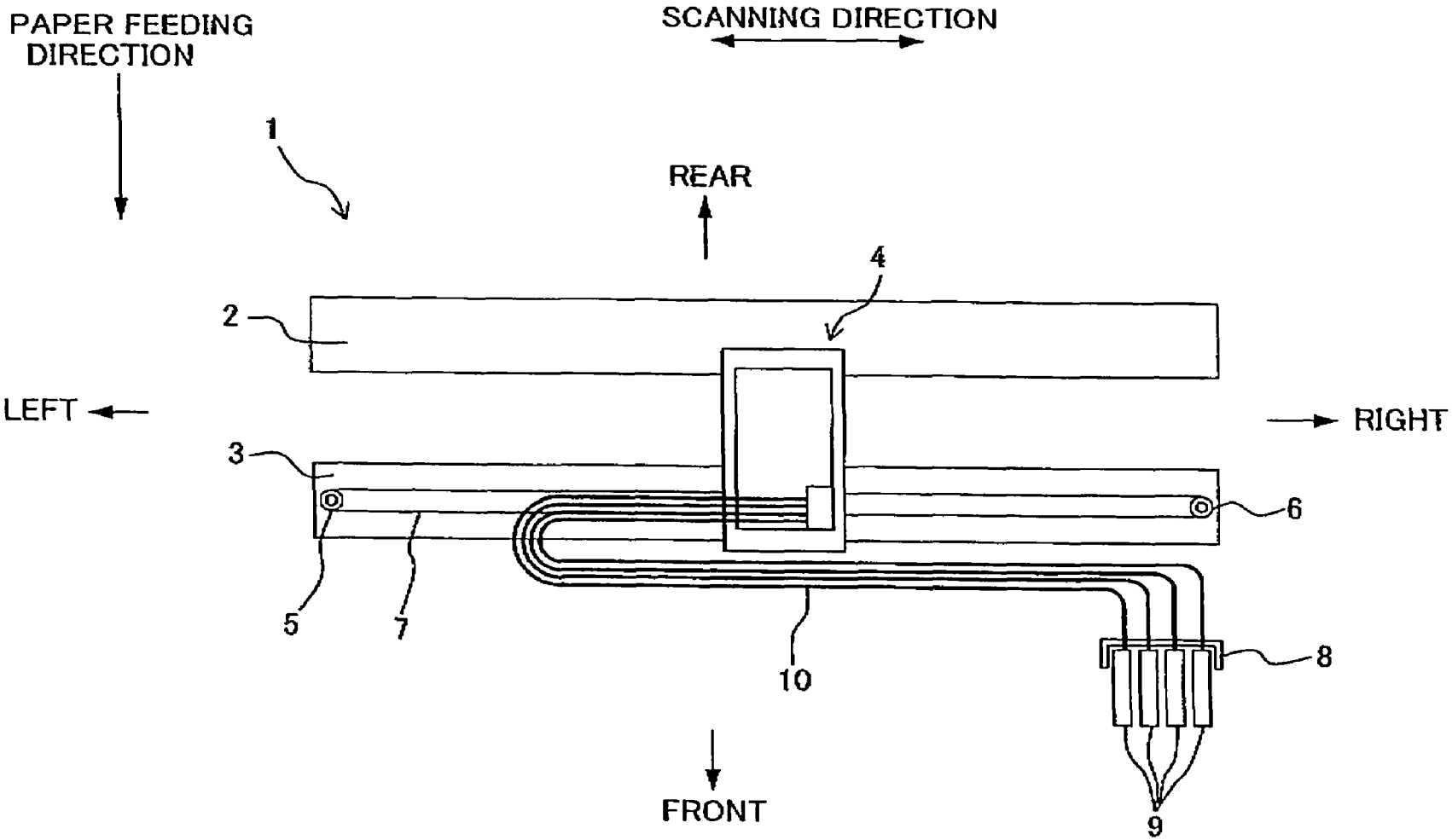
FIG. 1 is a schematic perspective view showing a substantial part of an ink-jet printer according to a first embodiment of the present invention.

FIG. 1 is a schematic perspective view showing a substantial part of an ink-jet printer 1 according to a first embodiment of the present invention. As shown in FIG. 1, in the ink-jet printer 1 (liquid-droplet jetting apparatus), a pair of guide rails 2, 3 are disposed substantially in parallel, and a head unit 4 is supported by the guide rails 2, 3 slidably in a scanning direction. The head unit 4 is joined to a timing belt 7 wound on a pair of pulleys 5, 6, and the timing belt 7 is disposed substantially in parallel to an extending direction of the guide rails 2, 3. One of the pulleys 6 is provided with a motor (not shown) for driving to rotate in a normal/reverse direction, and the timing belt 7 moves reciprocally by the pulley 6 being driven to rotate in a normal/reverse direction, and the head unit 4 is scanned reciprocally in one direction along the guide rails 2, 3.

Four ink supply tubes 10 having flexibility are connected to the head unit 4, through which inks of four colors (black, cyan, magenta, yellow) are supplied respectively from four ink cartridges 9 (liquid supply source) attached to the cartridge attaching part 8. On the head unit 4 an ink-jet head 21 (see FIG. 2) is mounted, and ink (liquid) is jetted from the ink-jet head 21 toward a recording media 11 (see FIG. 2) such as a paper carried below the ink-jet head 21 in a direction (paper feeding direction) orthogonal to the scanning direction.

Figure 2:
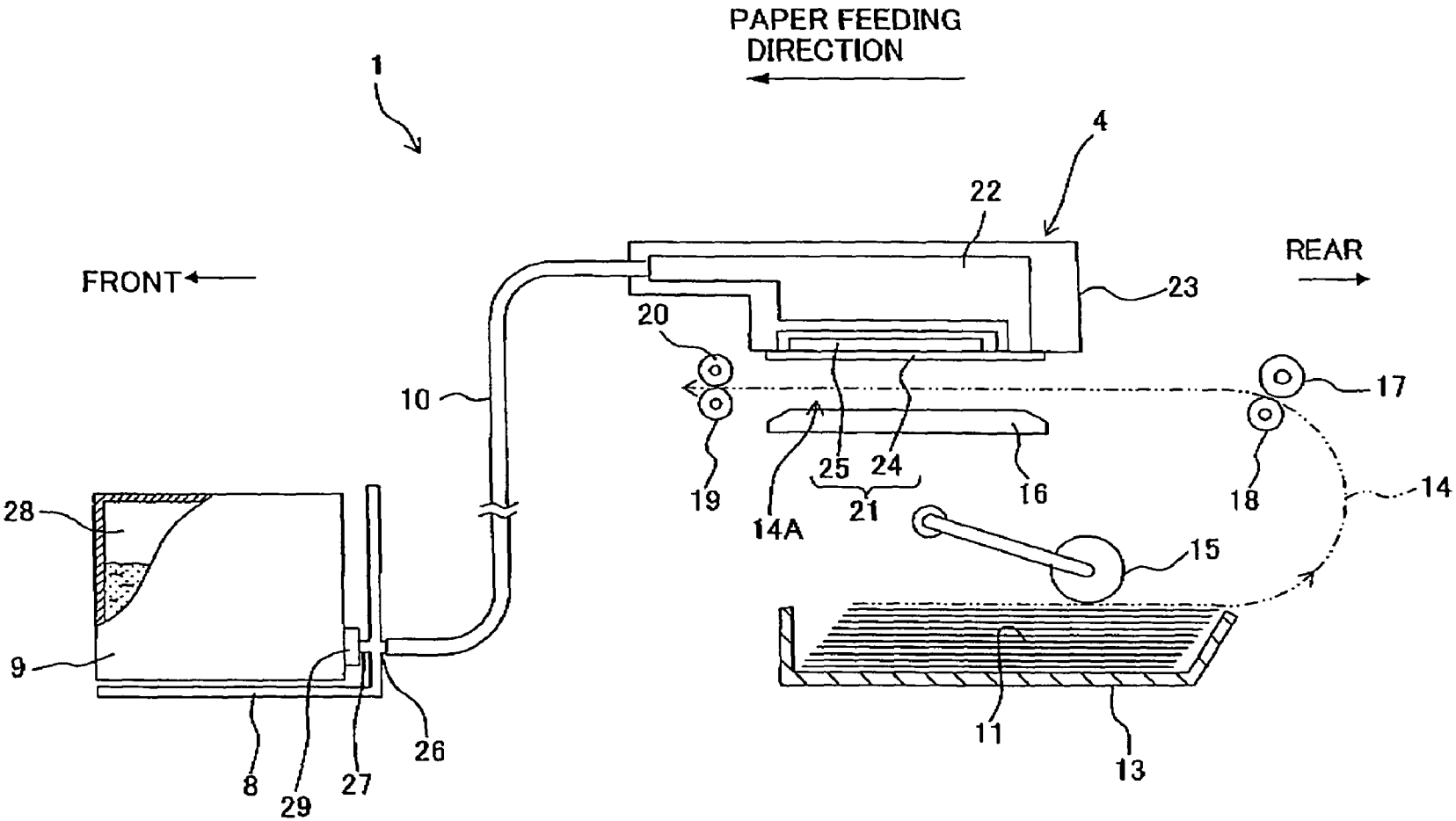
FIG. 2 is a partial cross-sectional view schematically explaining the ink-jet printer shown in FIG. 1.

FIG. 2 is a partial cross-sectional view schematically explaining the ink-jet printer 1 shown in FIG. 1. As shown in FIG. 2, a paper feeding tray 13 is provided on a bottom side of the ink-jet printer 1. On an upper side of the paper feeding tray 13, there is provided a paper feeding driving roller 15 supplying the uppermost one of the recording media 11 stacked on the paper feeding tray 13 to a feeding path 14. After heading upward from a rear surface side of the paper feeding tray 13, the feeding path 14 makes a U-turn toward a front surface side, passes through a printing region 15 and is guided to a paper discharging tray (not shown).

Above the printing region 15 the head unit 4 is provided. Below the head unit 4, a platen 16 supporting the recording media 11 is disposed. On an upstream side of the head unit 4, there are provided a feeding roller 17 and a pinch roller 18 which sandwich the recording medium 11 carried on the feeding path 14 and carry it to an upper side of the platen 16. On a downstream side of the head unit 4, there are provided a discharging roller 19 and a pinch roller 20 which sandwich the recording media 11 on which printing is performed and carry it to the paper discharging tray (not shown).

The head unit 4 has a known ink-jet head 21 (liquid-droplet jetting head) which jets ink through a plurality of nozzles toward the platen 16, a buffer tank 22 storing ink to be supplied to the ink-jet head 21, and a head holder 23 on which these parts are mounted. The ink-jet head 21 has a channel unit 24 with a plurality of channels (not shown) guiding the ink flowing in from the buffer tank 22 to the plurality of nozzles (not shown), and an actuator 25 of piezoelectrically driven type which selectively adds to the ink in a channel of the channel unit 24 a jetting pressure toward the nozzles.

One ends of the ink supply tubes 10 are coupled to the buffer tank 22, and the other ends of the ink supply tubes 10 are connected to the cartridge attaching part 8. The cartridge attaching part (cartridge installing part) 8 has coupling parts 26 coupled to the other ends of the ink supply tubes 10, and ink inlet portions 27 (liquid inlet portion) in a needle form coupled to the ink cartridges 9, and the coupling parts 26 and the ink inlet portions 27 communicate with each other. The ink cartridges 9 each have an ink storage chamber 28 formed therein and an ink outlet portion 29 to allow the ink in the ink storage chamber 28 to flow out. When the ink cartridges 9 are attached to the cartridge attaching part 8 and the ink inlet portions 27 are inserted in and coupled to the ink outlet portions 29, the ink storage chamber 28 communicates with the buffer tank via the ink outlet portions 29, the ink inlet portions 27, the coupling parts 26 and the ink supply tubes 10. Further, the buffer tank 22 is arranged at a position higher than the ink inlet portions 27 of the cartridge attaching part 8. That is, pressures are applied to the inks in the ink inlet portions 27 of the cartridge attaching part 8 via the ink supply tubes 10 by water head pressures of the inks in ink storage chambers 41 to 44 (see FIG. 5), which will be explained later, of the buffer tank 22.

Figure 3:
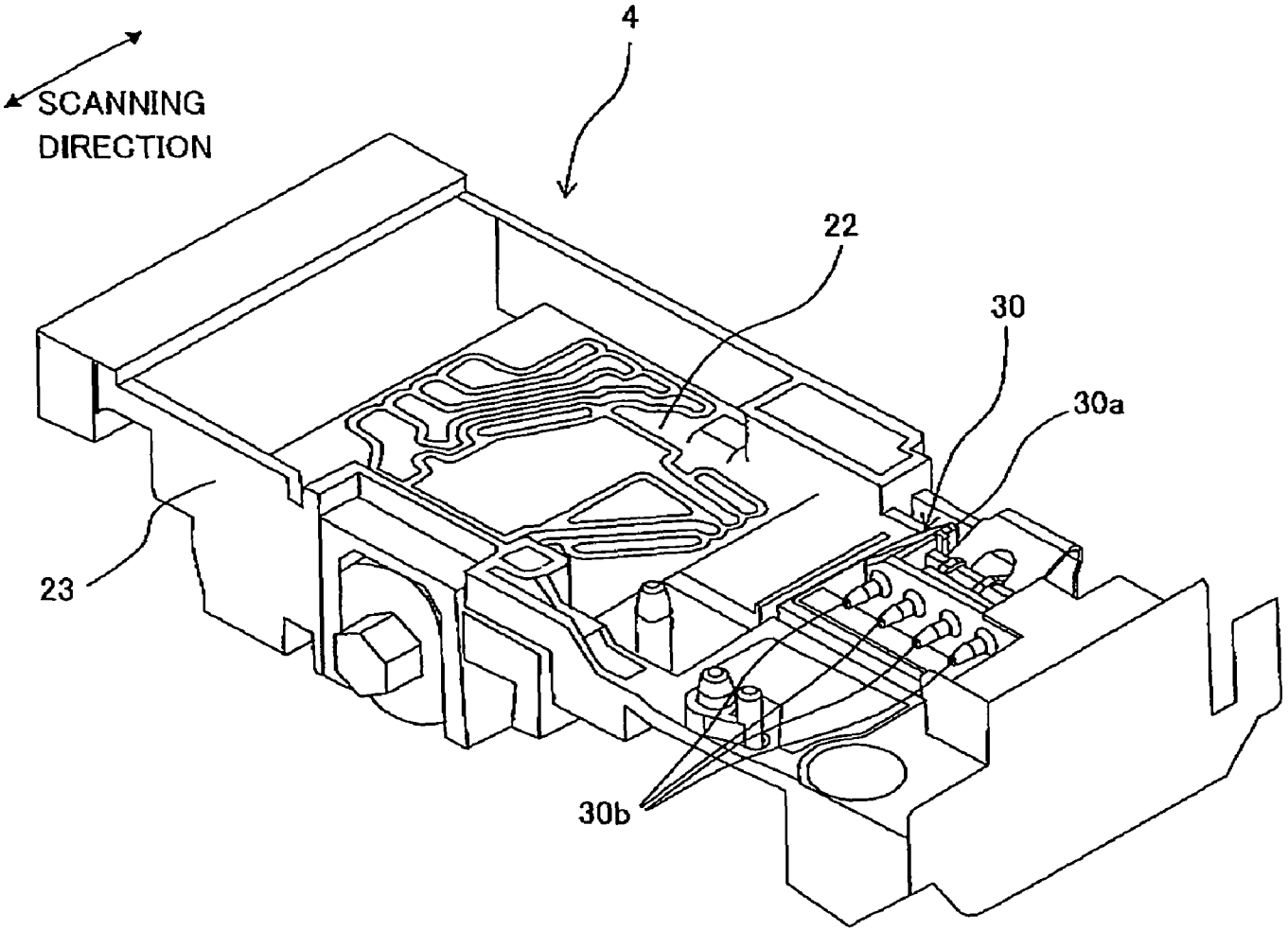
FIG. 3 is a perspective view seen from an upper side of a head unit of the ink-jet printer shown in FIG. 1.
Figure 4:
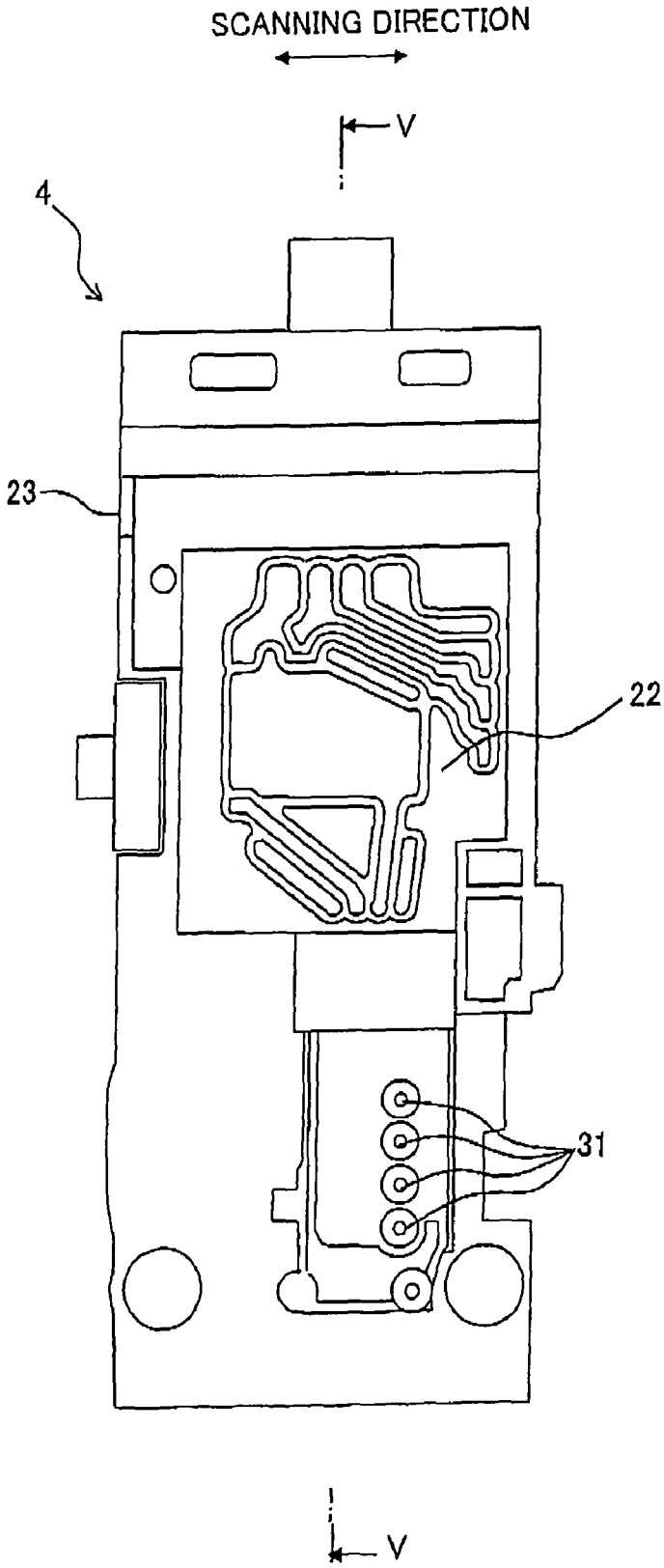
FIG. 4 is a top view of the head unit of the ink-jet printer shown in FIG. 1.

FIG. 3 is a perspective view seen from an upper side of the head unit 4 of the ink-jet printer 1 shown in FIG. 1. FIG. 4 is a top view of the head unit 4 of the ink-jet printer 1 shown in FIG. 1. Note that in FIG. 4 illustrations of a joint 30 shown in FIG. 3 and a seal member thereof are omitted. As shown in FIGS. 3 and 4, the head unit 4 is provided with the head holder 23 to be a carriage guided by the guide rails 2, 3 (see FIG. 1). The head holder 23 is formed in a box shape and has an opened upper surface, and the buffer tank 22 is accommodated therein. The ink-jet head 21 (see FIG. 2) is attached on a lower surface of a bottom wall of the head holder 23. A joint 30 is attached to the buffer tank 22. The joint 30 has a base portion 30*a* connected to an ink lead-in port 31 of the buffer tank 22, and four ink joint pipes 30*b* lead out from the base portion 30*a* in the scanning direction. One ends of the ink supply tubes 10 (see FIG. 1) are connected to these ink joint pipes 30*b*.

Figure 5:
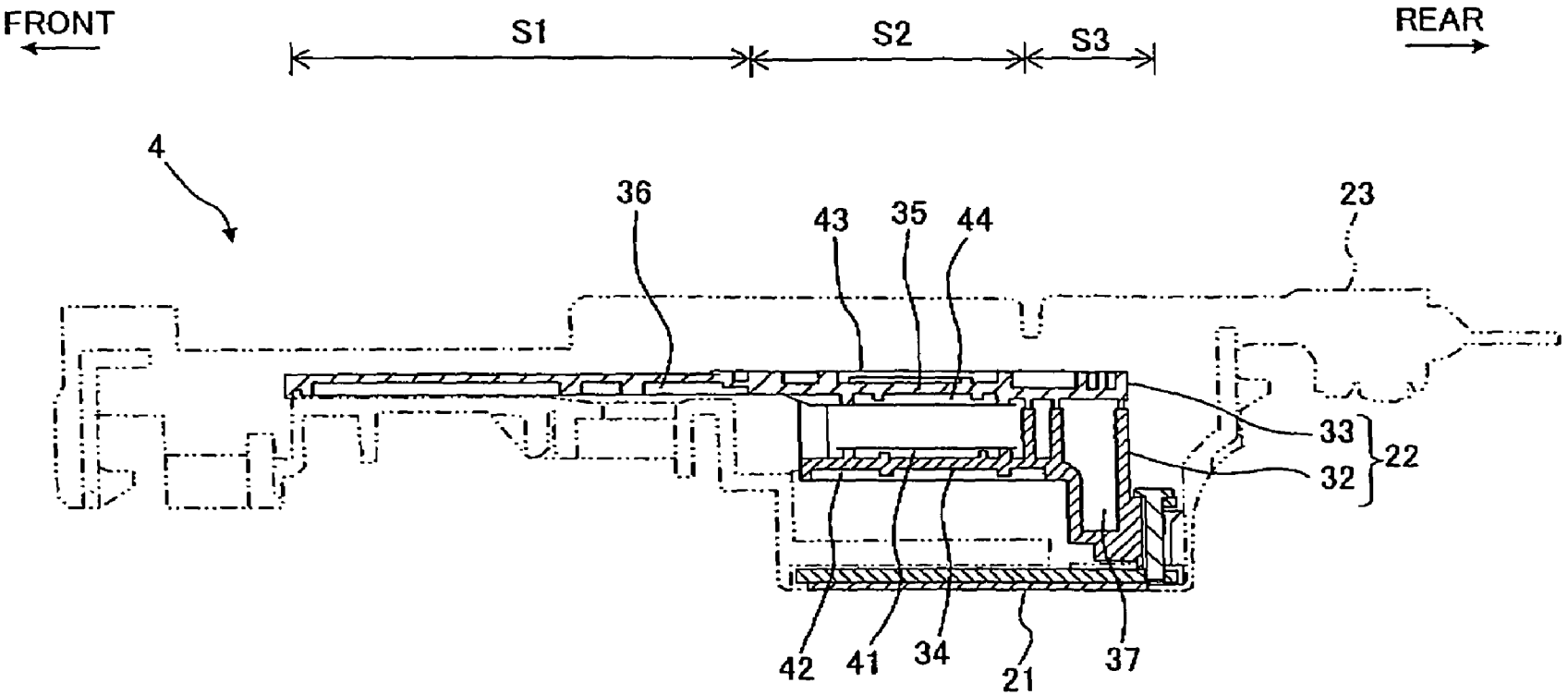
FIG. 5 is a cross-sectional view taken along a line V-V in FIG. 4.

FIG. 5 is a cross-sectional view taken along a line V-V in FIG. 4. Note that in FIG. 5, the head holder 23 is displayed by a chain double-dashed line to make the buffer tank 22 easily visible. As shown in FIG. 5, in the buffer tank 22, a lower tank part 32 and an upper tank part 33 are joined in parallel to each other, and there are formed an ink lead-in area (ink introducing area) S1, a buffer area S2 and an ink lead-out area S3 in order from the front side in a front-back direction.

In the buffer area S2, in the lower tank part 32 an ink storage chamber 41 (liquid storage chamber) storing a cyan ink and an ink storage chamber 42 (liquid storage chamber) storing a black ink are formed on an upper side and a lower side of a middle wall 34 of the lower tank part 32, respectively, the middle wall 34 being sandwiched between the ink storage chamber 41, 42. In the upper tank part 33, an ink storage chamber 43 (liquid storage chamber) storing a yellow ink and an ink storage chamber 44 (liquid storage chamber) storing a magenta ink are formed on an upper side and a lower side of a middle wall 35 sandwiched therebetween, respectively. These ink storage chambers 41 to 44 are arranged in parallel to each other and arranged in a stacked state in a vertical direction. In the ink lead-in area S1, in the upper tank part 33 there are formed channels 36 connecting the four ink lead-in ports 31 and the ink storage chambers 41 to 44. In the ink lead-in area S3, four ink lead-out channels 37 corresponding to the ink storage chambers 41 to 44 respectively are formed to be arranged in the scanning direction of the ink-jet head 21 on a rear side of the buffer area S2.

Figure 6:
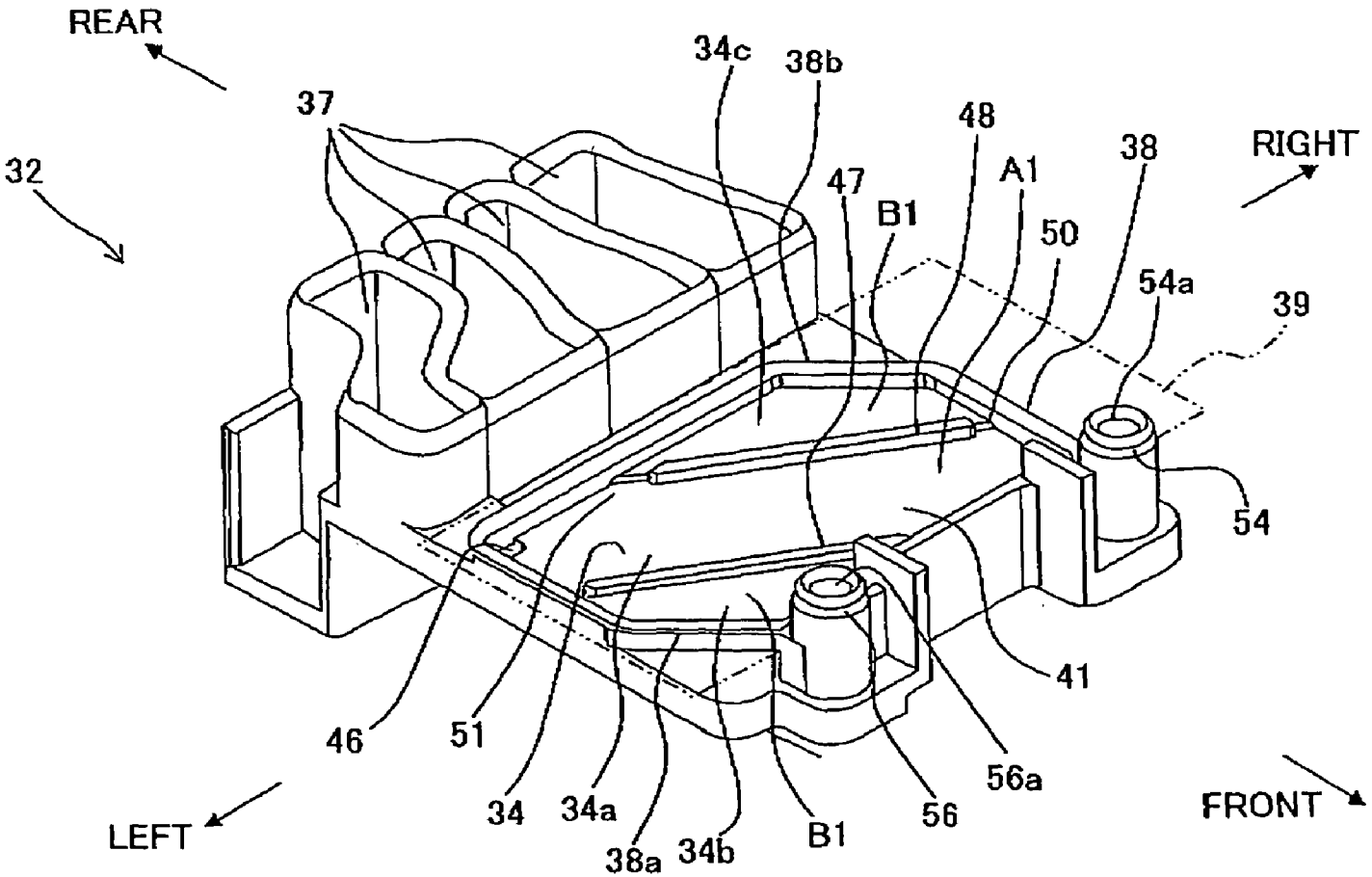
FIG. 6 is a perspective view of a lower tank part shown in FIG. 5 seen from an upper side.
Figure 7:
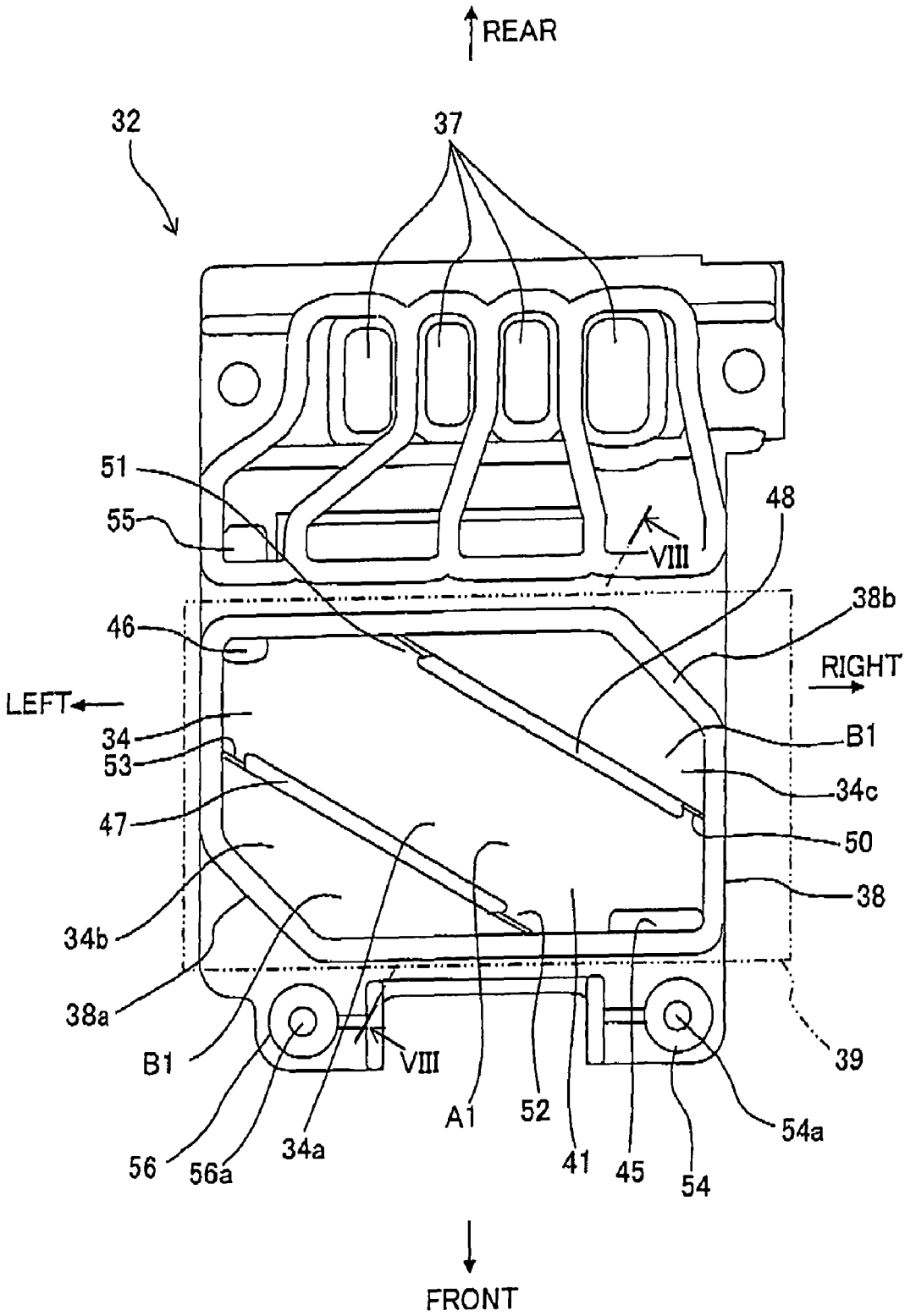
FIG. 7 is a top view of the lower tank part shown in FIG. 6.

FIG. 6 is a perspective view of the lower tank part 32 shown in FIG. 5 seen from an upper side. FIG. 7 is a top view of the lower tank part 32 shown in FIG. 6. As shown in FIGS. 6 and 7, on an upper side of the middle wall 34 of the lower tank part 32, the flat ink storage chamber 41 for the cyan ink is partitioned by a surrounding wall 38 and is opened upward. An opening of the ink storage chamber 41 for the cyan ink is enclosed by adhering a resin film 39 having flexibility in a rectangular shape in plan view on an upper end of the surrounding wall 38. Namely, the resin film 39 is a damper wall 39 facing the middle wall 34 in a vertical direction with a distance therebetween. At this time, for the resin film forming the damper wall 39, shape processing after cutting is omitted by adhering the film in a rectangular shape in a state of being cut from a roll film by a film cutter as it is to the surrounding wall 38. Note that as a resin film forming the damper wall 39, films of PET, nylon, polypropylene, and the like can be used. These films may be used as a single film, or a few of them may be stacked and used. The thickness of the resin film/films may be about 60 μm in total.

An ink inlet port 45 and an ink outlet port 46 are provided at substantially diagonal positions in the ink storage chamber 41. The ink inlet port 45 (liquid inlet port) for the cyan ink is opened in a bottom surface in the vicinity of a corner portion on a right-front side in the ink storage chamber 41, and penetrates the middle wall 34 of the lower tank part 32 in a thickness direction to be connected to a communication channel 54*a* on a lower surface side of the middle wall 34. The communication channel 54*a* is formed of a cylindrical portion 54 provided to stand on the middle wall 34 on the right-front side of the ink storage chamber 41, and is connected to a communication channel 117*a* (see FIG. 13) which will be explained later. Namely, the ink inlet port 45 communicates with one of the channels 36 of the upper tank part 33 (see FIG. 5) via the communication channel 54*a* and the communication channel 117*a* (see FIG. 13).

The ink outlet port 46 of the ink storage chamber 41 is opened in a bottom surface in the vicinity of a corner portion on a left rear side of the ink storage chamber 41, and penetrates the middle wall 34 of the lower tank part 32 in the thickness direction to be connected to a connection lead-out channel 55 on a lower surface side of the lower tank part 32. The connection lead-out channel 55 communicates with one of the ink lead-out channels 37. Then the above-described middle wall 34 and the damper wall 39 are provided substantially in parallel to a flow direction of the ink from the ink inlet port 45 toward the ink outlet port 46.

Further, on an upper surface of the middle wall 34 in the ink storage chamber 41, a pair of flow regulating ribs 47, 48 projecting toward the damper wall 39 is provided. The pair of flow regulating ribs 47, 48 extends substantially in parallel to a flow direction of the ink from the ink inlet port 45 toward the ink outlet port 46, and a cross section orthogonal to an extending direction thereof is a rectangular shape. Further, the pair of flow regulating ribs 47, 48 is separated from the damper wall 39 so as not to limit movement of the damper wall 39. An inside space sandwiched by the pair of flow regulating ribs 47, 48 becomes a main flow region A1 from the ink inlet port 45 toward the ink outlet port 46, and outside spaces between the flow regulating ribs 47, 48 and the surrounding wall 38 become sub-flow regions B1. Further, surfaces of the flow regulating ribs 47, 48 facing each other extend substantially in parallel to the flow direction, and form rising portions projecting from the middle wall 34 toward the damper wall 39. As will be explained later, distances between bottom surfaces defining the sub-flow regions B1 and the damper wall 39 are shorter than a distance between a bottom surface defining the main flow region A1 and the damper wall 39. That is, the bottom surfaces defining the sub-flow regions B1 outside the pair of flow regulating ribs 47, 48 are formed one step higher than the bottom surface defining the main flow region A1 inside sandwiched by the pair of flow regulating ribs 47, 48. In other words, steps are formed between the sub-flow regions B1 outside the pair of flow regulating ribs 47, 48 and the main flow region A1 inside. Further, end portions of the flow regulating ribs 47, 48 in the ink flow direction are provided with small gaps 50 to 53 from the surrounding wall 38 in the extending direction thereof. Accordingly, the main flow region A1 and the sub-flow regions B1 are connected via the gaps 50 to 53.

Moreover, the surrounding wall 38 has a shape such that the corners corresponding to the sub-flow regions B1 in a rectangular shape in plan view are removed. Specifically, corner chamfered portions (chamfered edge portions) 38*a*, 38*b* are formed in a straight shape so that the surrounding wall 38 has a substantially hexagonal shape in plan view. Thus, since the corner chamfered portions 38*a*, 38*b* are formed to be close to the flow regulating ribs 47, 48, the volumes of the sub-flow regions B1 become small and channel cross-sectional areas orthogonal to a flow direction of the sub-flow regions B1 become small. Namely, the volume of the ink storage chamber 41 becomes smaller as compared to the case of being a rectangular shape from which the corners are not chamfered. Specifically, as compared to the case where the surrounding wall 38 is a rectangular shape from which the corner portions are not chamfered, the area of the ink storage chamber 41 in plan view is reduced by 10 to 30%, preferably 15 to 25%. Note that the corner chamfered portions 38*a*, 38*b* may be formed in a smoothly curved shape.

Accompanying jetting of ink for ordinarily printing, the ink flows from the ink inlet port 45 to the ink outlet port 46 through the main flow region A1 between the pair of flow regulating ribs 47, 48. There is a possibility that the sub-flow regions B1 outside the flow regulating ribs 47, 48 become stagnation portions where air remains, but at a flow rate of the ink during ordinarily printing, sucking of the air into the ink outlet port 46 is prevented by the flow regulating ribs 47, 48.

Further, when a flow faster than the flow of the ink accompanying jetting of the ink for ordinarily printing is generated by a purge operation, a stable flow is formed in the main flow region A1 between the pair of flow regulating ribs 47, 48, and the air in the ink can be discharged quickly. Here, the purge operation means to bring a known suction cap into airtight contact with the nozzle surface of the ink-jet head 21 and suck any remaining ink from the nozzles with a negative pressure by a suction pump. At this time, any ink or air in the sub-flow regions B1 being the stagnation portions is also sucked via the gaps 50 to 53. Thus, even when a mixed-color ink exists in the sub-flow regions B1, it is discharged by the purge operation. Note that the purge operation may be such that, instead of performing suction by a negative pressure from the nozzle side of the ink-jet head 21, a positive pressure is applied from the buffer tank 22 side to discharge ink from the nozzles.

Figure 8:
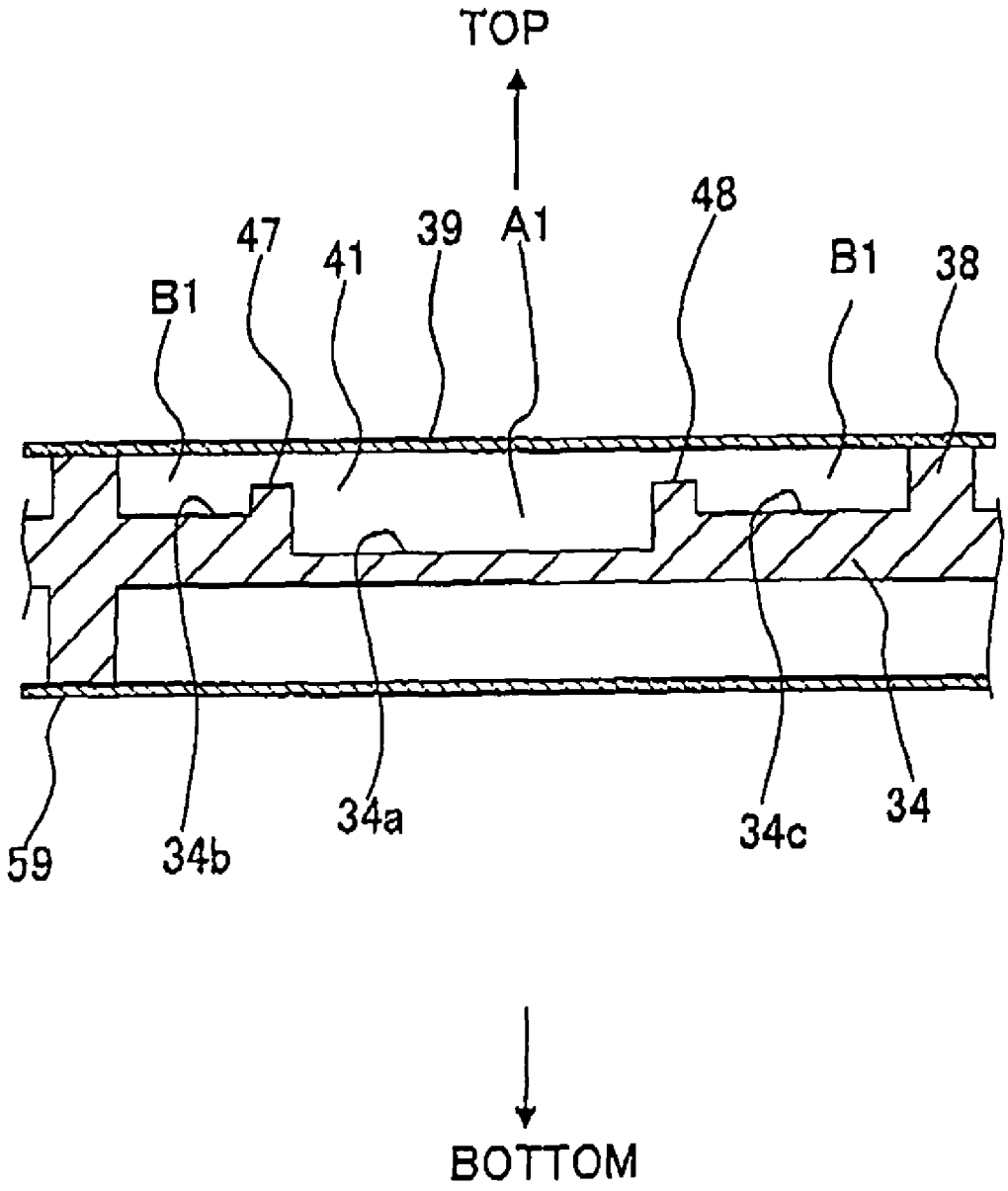
FIG. 8 is a cross-sectional view taken along a line VIII-VIII in FIG. 7.

FIG. 8 is a cross-sectional view taken along a line VIII-VIII in FIG. 7. As shown in FIG. 8, a bottom surface 34*a* of the main flow region A1 is flat, and bottom surfaces 34*b*, 34*c* in the sub-flow regions B1 on the more outside than the flow regulating ribs 47, 48 are also flat. Distances between the middle wall 34 and the damper wall 39 in the sub-flow regions B1 are smaller than a distance between the middle wall 34 and the damper wall 39 in the main flow region A1. Accordingly, the volumes of the sub-flow regions B1 become small, and the channel cross-sectional areas orthogonal to the flow direction of the sub-flow regions B1 also become small. Further, the distances between the middle wall 34 and the damper wall 39 in the sub-flow regions B1 are not as small as distances between upper ends of the flow regulating ribs 47, 48 and the damper wall 39. That is, the distances between the middle wall 34 and the damper wall 39 in the sub-flow regions B1 are set to be relatively larger. Accordingly, when the resin film to be the damper wall 39 is adhered onto the upper end of the surrounding wall 38, it is prevented that a molten mass of the resin film flows on the surrounding wall 38 and reaches the middle wall 34.

Figure 9:
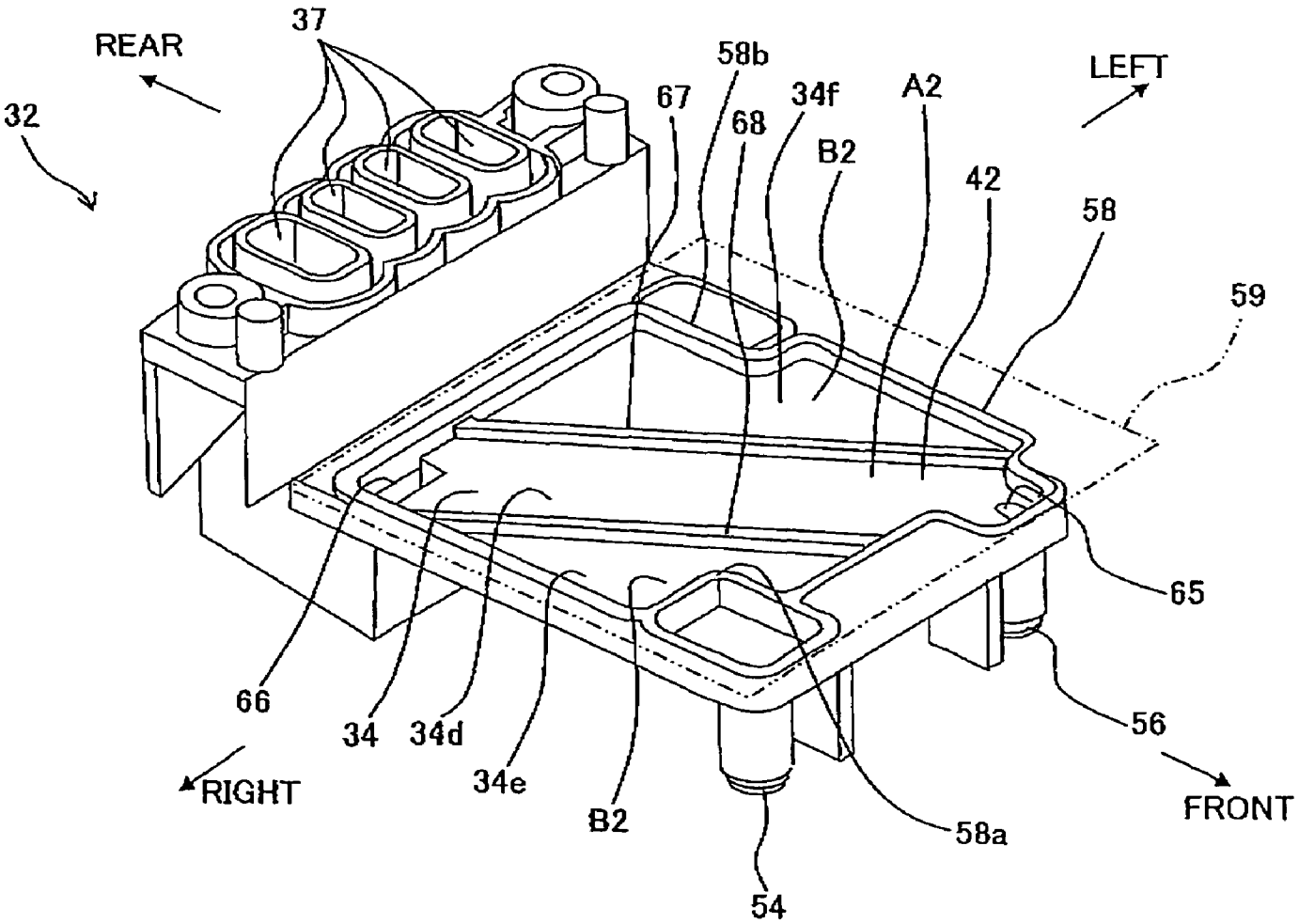
FIG. 9 is a perspective view of the lower tank part shown in FIG. 5 seen from a lower side.
Figure 10:
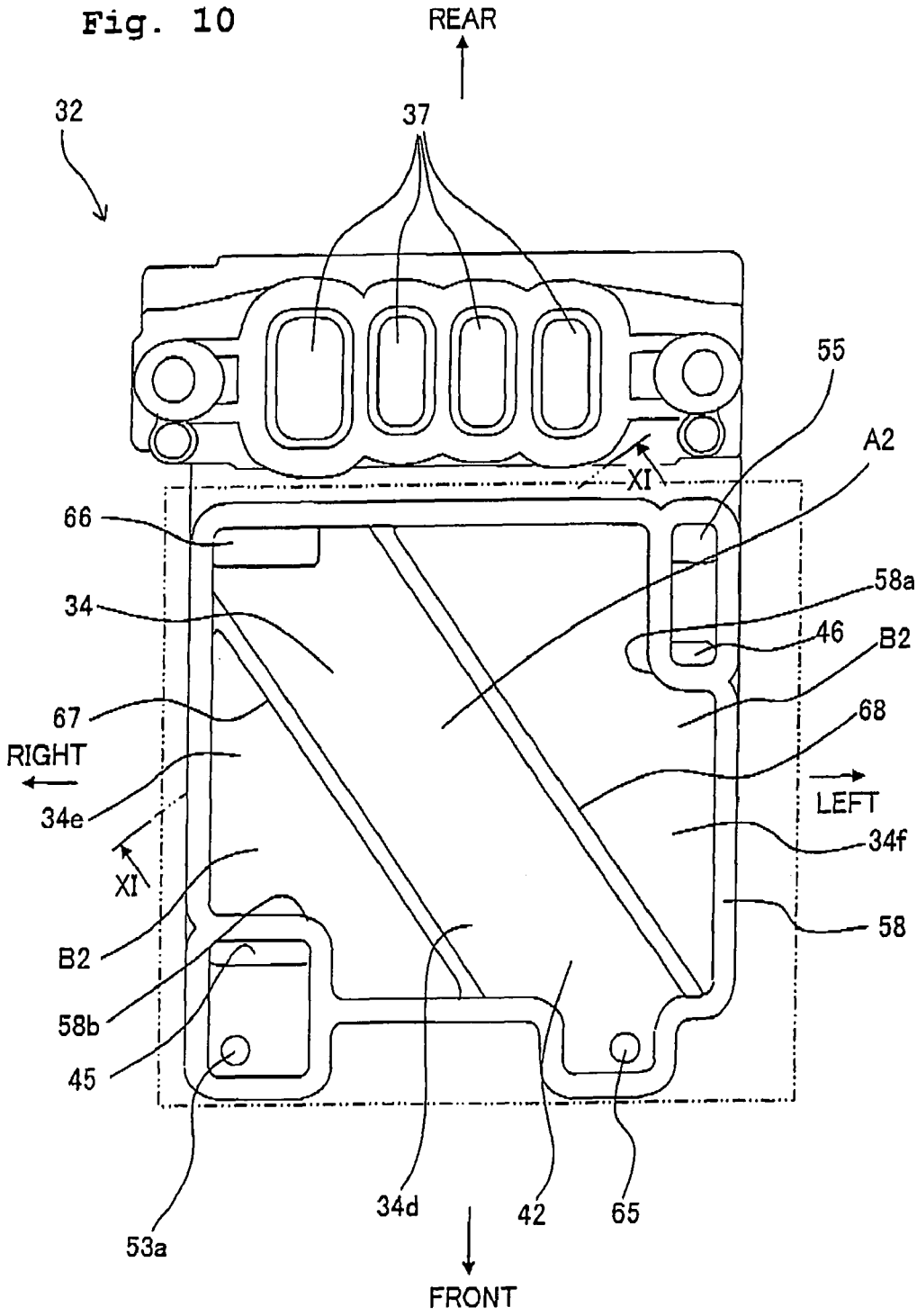
FIG. 10 is a bottom view of the lower tank part shown in FIG. 9.

FIG. 9 is a perspective view of the lower tank part 32 shown in FIG. 5 seen from a lower side. FIG. 10 is a bottom view of the lower tank part 32 shown in FIG. 9. Note that since FIG. 9 is a view seen from the lower side, the upward direction in the view is a downward direction, and the downward direction in the view is an upward direction. As shown in FIGS. 9 and 10, on a lower side of the middle wall 34 of the lower tank part 32, the flat ink storage chamber 42 for the black ink is partitioned by a surrounding wall 58 and is opened downward. An opening face of the ink storage chamber 42 for the black ink is enclosed by adhering a resin film 59 having flexibility in a rectangular shape in plan view on a lower end of the surrounding wall 58. Namely, the resin film 59 is a damper wall 59 facing the middle wall 34 in a vertical direction with a distance therebetween.

An ink inlet port 65 and an ink outlet port 66 are provided at substantially diagonal positions in the ink storage chamber 42. The ink inlet port 65 for the black ink is opened in a bottom surface in the vicinity of a corner portion on a left-front side in the ink storage chamber 42, and penetrates the middle wall 34 of the lower tank part 32 in a thickness direction. A front side portion of the ink storage chamber 42 is positioned overlapping with a communication channel 56*a* (see FIG. 6) in a plan view, and a lower end opening of the communication channel 56*a* is the ink inlet port 65 of the ink storage chamber 42. This communication channel 56*a* is formed of a cylindrical portion 56 provided to stand on the middle wall 34 on the left-front side of the ink storage chamber 42, and is connected to a communication channel 116*a* (see FIG. 13) which will be explained later. Namely, the ink inlet port 65 communicates with one of the channels 36 of the upper tank part 33 (see FIG. 5) via the communication channel 56*a* and the communication channel 116*a* (see FIG. 13).

The ink outlet port 66 of the ink storage chamber 42 is opened in a bottom surface in the vicinity of a corner portion on a right rear side of the ink storage chamber 42, and penetrates the middle wall 34 of the lower tank part 32 in the thickness direction to communicate with one of the ink lead-out channels 37 on an upper surface side of the lower tank part 32. Further, the ink storage chamber 42 for the black ink and the ink storage chamber 41 for the cyan ink are adjacent to each other vertically with the middle wall 34 of the lower tank part 32 therebetween, where a line connecting the ink inlet port 65 for the black ink and the ink outlet port 66 and another line connecting the ink inlet port 45 for the cyan ink and the ink outlet port 46 extend in different directions along the middle wall 34 and cross each other like diagonal lines.

On an upper surface of the middle wall 34 in the ink storage chamber 42, a pair of flow regulating ribs 67, 68 projecting toward the damper wall 59 is provided. The pair of flow regulating ribs 67, 68 extends substantially in parallel to a flow direction of the ink from the ink inlet port 65 toward the ink outlet port 66, and a cross section orthogonal to an extending direction thereof is a rectangular shape. Further, the pair of flow regulating ribs 67, 68 is provided in a state of being separated from the damper wall 59 so as not to limit movement of the damper wall 59. An inside space sandwiched by the pair of flow regulating ribs 67, 68 becomes a main flow region A2 from the ink inlet port 65 toward the ink outlet port 66, and outside spaces between the flow regulating ribs 67, 68 and the surrounding wall 58 become sub-flow regions B2. As will be explained later, in the ink storage chamber 42 storing the black ink, distances between bottom surfaces 34*e*, 34*f* defining the sub-flow regions B2 outside the pair of flow regulating ribs 67, 68 and the damper wall 59 are equal to a distance between a bottom surface 34*d* defining the main flow region A2 sandwiched by the pair of flow regulating ribs 67, 68 and the damper wall 59. That is, steps like those in the ink storage chambers storing color inks are not formed between the main flow region A2 inside the flow regulating ribs 67, 68 and the sub-flow regions B2 outside the ribs. Further, since a problem of mixed colors does not occur easily with the black ink as it remains black when mixed with another color, end portions in the extending direction of the flow regulating ribs 67, 68 are connected to inner wall surfaces of the surrounding wall 58 and no gaps are formed therebetween for enhancing the flow regulating effect.

Moreover, when seen from a direction orthogonal to normals of the middle wall 34 and the damper wall 39 (hereinafter simply described as "in a plan view"), the surrounding wall 58 has a shape in which the corners corresponding to the sub-flow regions B2 in a rectangular shape are chamfered such that the corners are recessed (dented) inward in substantially L-shapes Thus, by corner chamfered portion (corner removal portions) 58*a*, 58*b* being formed to be close to the flow regulating ribs 67, 68, the volumes of the sub-flow regions B2 become small, and channel cross-sectional areas orthogonal to a flow direction of the sub-flow regions B2 become small partially. Namely, the volume of the ink storage chamber 42 becomes smaller as compared to the case of being a rectangular shape from which the corners are not chamfered.

Figure 11:
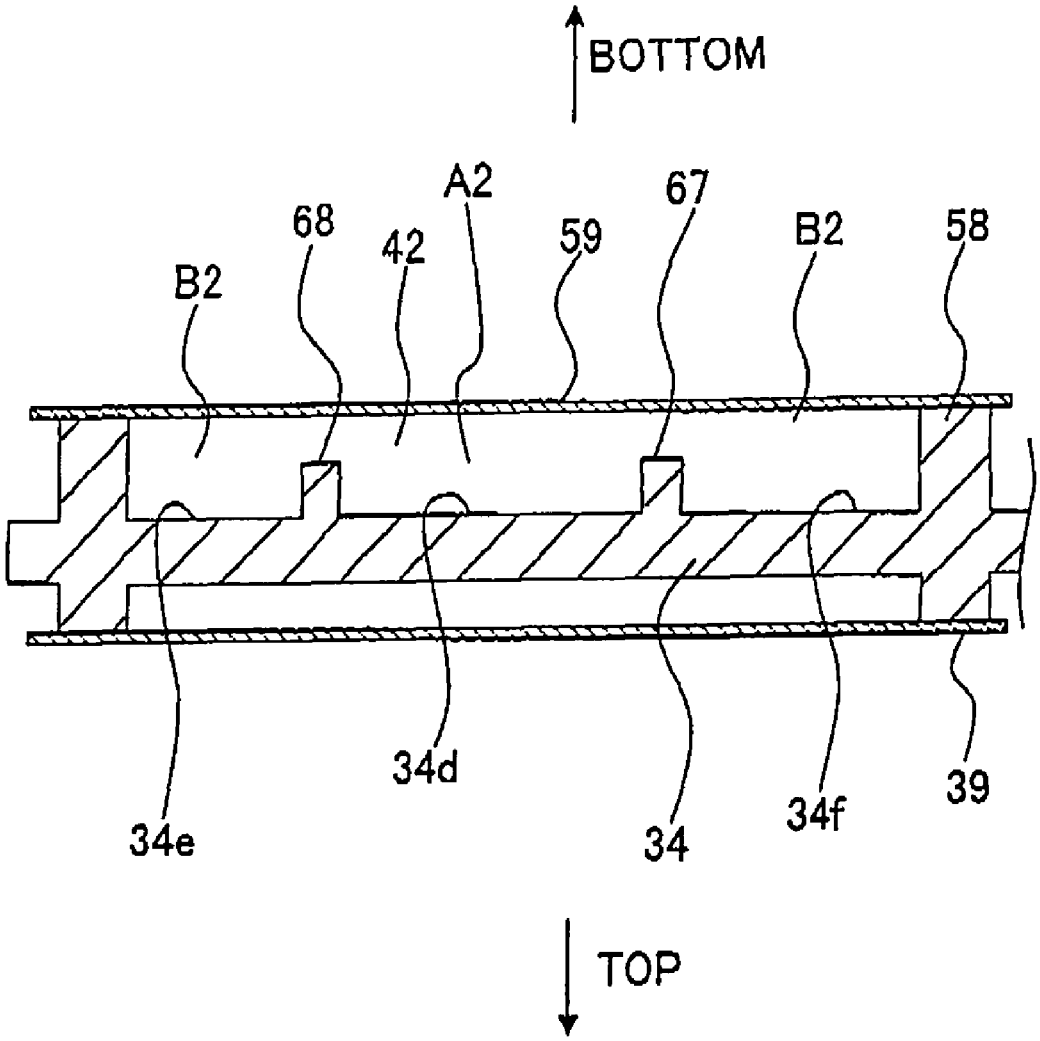
FIG. 11 is a cross-sectional view taken along a line XI-XI in FIG. 10.

FIG. 11 is a cross-sectional view taken along a line XI-XI in FIG. 10. As shown in FIG. 11, a bottom surface 34*d* of the main flow region A2 is flat, and bottom surfaces 34*e*, 34*f* in the sub-flow regions B2 outside of the flow regulating ribs 67, 68 are also flat. A distance between the middle wall 34 and the damper wall 59 in the main flow region A2 is equal to that in the sub-flow regions B2. That is, distances between the bottom surfaces 34*e*, 34*f* defining the sub-flow regions B2 outside the pair of flow regulating ribs 67, 68 and the damper wall 59 are equal to a distance between the bottom surface 34*d* defining the main flow region A2 sandwiched by the pair of flow regulating ribs 67, 68 and the damper wall 59. This is because flow rates in the sub-flow regions B2 to be stagnation portions are not necessarily be as fast as in the ink storage chamber 41 for the cyan ink, since a problem of mixing with another color does not easily occur with the black ink. Further, the distances between the middle wall 34 and the damper wall 59 in the vicinity of the surrounding wall 58 in the sub-flow regions B2 are not as small as distances between upper ends of the flow regulating ribs 67, 68 and the damper wall 59. Accordingly, when the resin film to be the damper wall 59 is adhered onto the upper end of the surrounding wall 58, it is prevented that a molten mass of the resin film flows on the surrounding wall 58 and reaches the middle wall 34.

Figure 12:
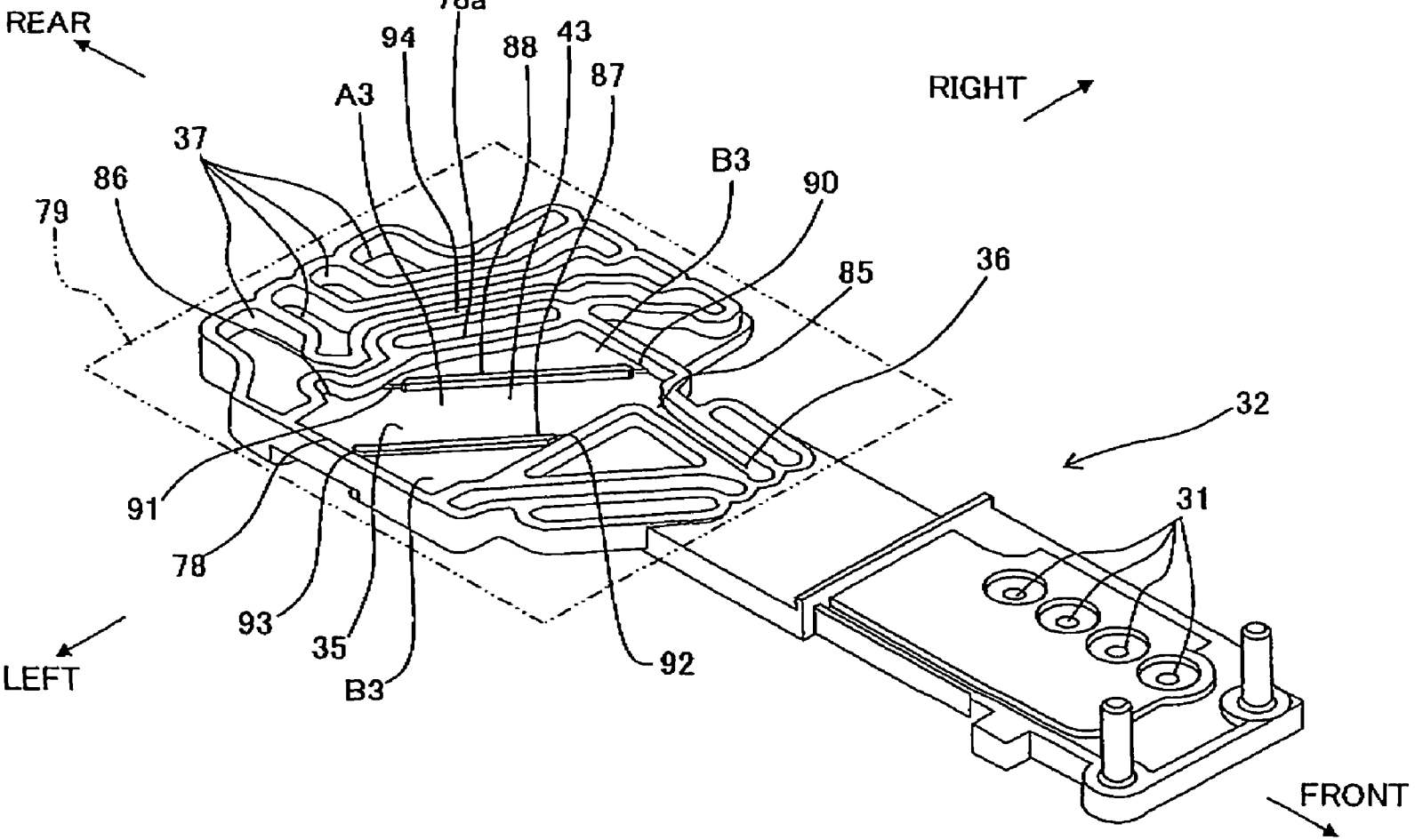
FIG. 12 is a perspective view of an upper tank part shown in FIG. 5 seen from an upper side.

FIG. 12 is a perspective view of the upper tank part 33 shown in FIG. 5 seen from an upper side. As shown in FIG. 12, a surrounding wall 78 in a substantially rectangular shape in a plan view is provided on an upper surface of the middle wall 35 of the upper tank part 33 in the buffer area S2 (see FIG. 5). The surrounding wall 78 defines the ink storage chamber 43 for the yellow ink opening downward. An opening of the ink storage chamber 43 for the yellow ink is enclosed (sealed) by a resin film 79 having flexibility in a rectangular shape in a plan view adhered on an upper end of the surrounding wall 78. Namely, the resin film 79 is a damper wall 79 facing the middle wall 35 in a vertical direction with a distance therebetween. Note that the ink storage chamber 43 for the yellow ink which will be explained below has substantially the same structure as the above-described ink storage chamber 41 for the cyan ink.

In the ink storage chamber 43, in the vicinity of a corner portion on a right-front side of the surrounding wall 78, a downstream end of one of the channels 36 in the ink lead-in area S1 communicating with one of the ink lead-in ports 31 communicates therewith as an ink inlet port 85. Further, an ink outlet port 86 of the ink storage chamber 43 is opened in a bottom surface in the vicinity of a corner portion on a left-rear side of the ink storage chamber 43, and penetrates the middle wall 34 of the upper tank part 33 in the thickness direction to communicate with one of the ink lead-out channels 37 on a lower surface side of the upper tank part 33.

Further, on an upper surface of the middle wall 35 in the ink storage chamber 43, a pair of flow regulating ribs 87, 88 projecting toward the damper wall 79 is provided. The pair of flow regulating ribs 87, 88 extends substantially in parallel to a flow direction of the ink from the ink inlet port 85 toward the ink outlet port 86, and a cross section orthogonal to an extending direction thereof is a rectangular shape. Further, the pair of flow regulating ribs 87, 88 is separated from the damper wall 79 so as not to limit movement of the damper wall 79. As will be explained later, distances between bottom surfaces defining the sub-flow regions B3 and the damper wall 79 are shorter than a distance between a bottom surface defining the main flow region A3 and the damper wall 39. That is, the bottom surfaces defining the sub-flow regions B3 are formed one step higher than the bottom surface defining the main flow region A3. In other words, steps are formed between the main flow region A3 inside sandwiched by the pair of flow regulating ribs 87, 88 and the sub-flow regions B3 outside the pair of flow regulating ribs 87, 88.

End portions of the flow regulating ribs 87, 88 in the ink flow direction are provided with small gaps 90 to 93 from the surrounding wall 78 in the extending direction thereof. Accordingly, the main flow region A3 and the sub-flow regions B3 are connected via the gaps 90 to 93. Moreover, the surrounding wall 78 has a shape such that the corner corresponding to the sub-flow region B3 on a right-rear side among corners of a rectangular shape in plan view is chamfered by a corner chamfered portion 78*a* in a straight shape. Thus, by the corner chamfered portion 78*a* being formed to be close to the flow regulating rib 88, the volume of the sub-flow region B3 becomes small, and a channel cross-sectional area orthogonal to a flow direction of the sub-flow region B3 becomes small partially. Namely, the volume of the ink storage chamber 43 becomes smaller as compared to the case of being a rectangular shape from which the corner is not chamfered. Further, the resin film forming the damper wall 79 encloses not only an upper opening of the surrounding wall 78 in the buffer area S2 but upward open portions of the channels 36 in the ink lead-in area S1 and the ink lead-out channels 37 in the ink lead-out area S3. Then upper spaces of the ink lead-out channels 37 enclosed by the damper wall 79 constructed of the resin film are used as air trap chambers 94.

Figure 13:
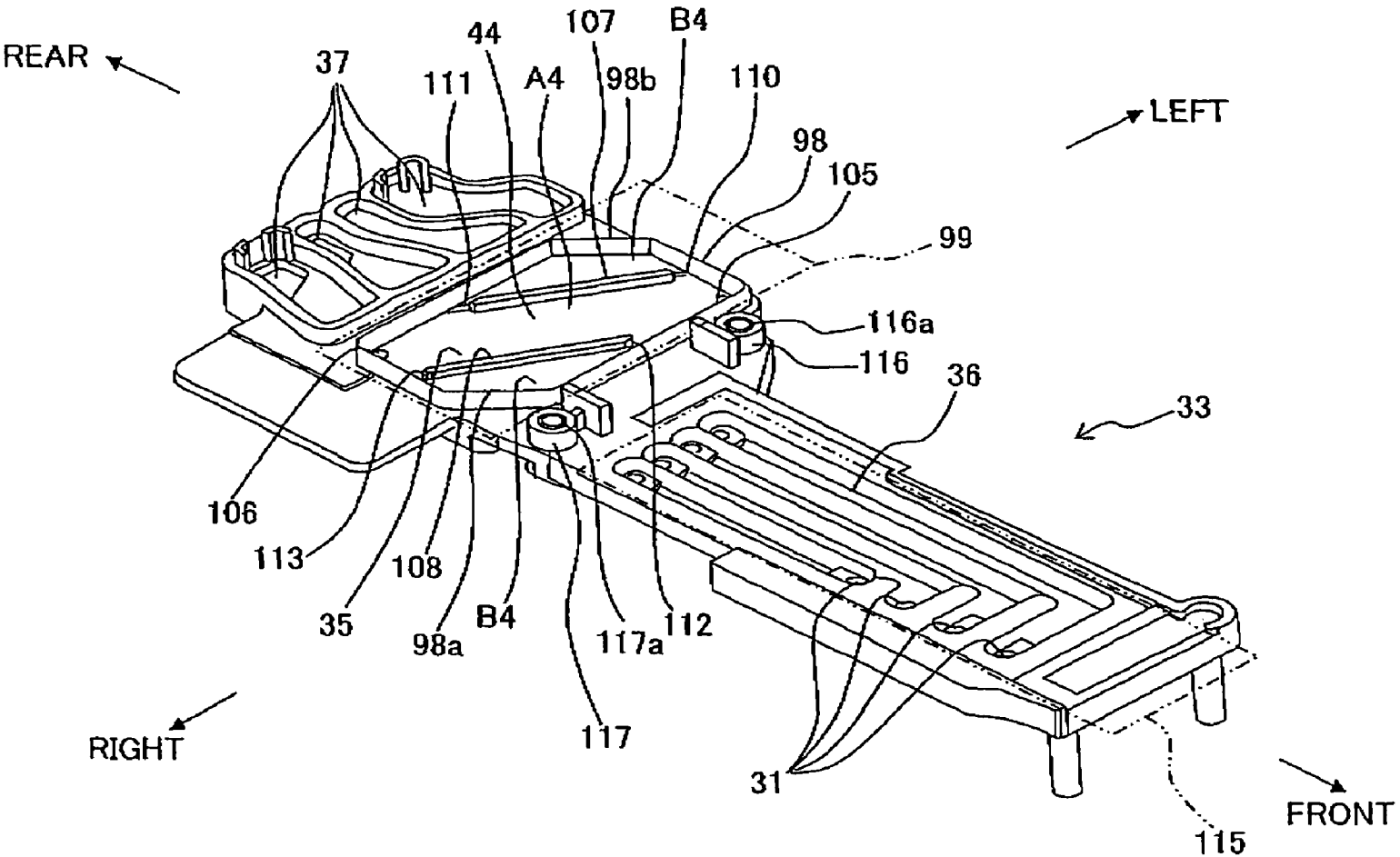
FIG. 13 is a perspective view of the upper tank part shown in FIG. 5 seen from a lower side.

FIG. 13 is a perspective view of the upper tank part 33 shown in FIG. 5 seen from a lower side. Note that since FIG. 13 is a view seen from the lower side, the upward direction in the view is a downward direction, and the downward direction in the view is an upward direction. As shown in FIG. 13, on an upper side of the middle wall 35 of the upper tank part 33 in the buffer area S2 (see FIG. 5), the flat ink storage chamber 44 for the magenta ink opening upward is defined by a surrounding wall 98. An opening of the ink storage chamber 44 for the magenta ink is enclosed by a resin film 99 having flexibility in a rectangular shape in a plan view adhered on an upper end of the surrounding wall 98. Namely, the resin film 99 is a damper wall 99 facing the middle wall 35 in a vertical direction with a distance therebetween. Note that the ink storage chamber 44 for the magenta ink which will be explained below has substantially the same structure as the above-described ink storage chamber 41 for the cyan ink.

An ink inlet port 105 and an ink outlet port 106 are provided at substantially diagonal positions in the ink storage chamber 44. The ink inlet port 105 for the magenta ink is opened in a bottom surface in the vicinity of a corner portion on a left-front side in the ink storage chamber 44, and penetrates the middle wall 35 of the upper tank part 33 in a thickness direction to be connected to one of the channels 36 (see FIG. 5) on an upper surface side of the middle wall 35. The ink outlet port 106 of the ink storage chamber 44 is opened in a bottom surface in the vicinity of a corner portion on a right-rear side of the ink storage chamber 44, and penetrates the middle wall 35 of the upper tank part 33 in the thickness direction to communicate with one of the ink lead-out channels 37 on an upper surface side of the upper tank part 33.

On a lower surface of the middle wall 35 in the ink storage chamber 44, a pair of flow regulating ribs 107, 108 projecting toward the damper wall 99 is provided. The pair of flow regulating ribs 107, 108 extends substantially in parallel to a flow direction of the ink from the ink inlet port 105 toward the ink outlet port 106, and a cross section orthogonal to an extending direction thereof is a rectangular shape. Further, the pair of flow regulating ribs 107, 108 is separated from the damper wall 99 so as not to limit movement of the damper wall 99. As will be explained later, distances between bottom surfaces defining sub-flow regions B4 and the damper wall 99 are shorter than a distance between a bottom surface defining a main flow region A4 and the damper wall 99. That is, the bottom surfaces defining the sub-flow regions B4 outside the pair of flow regulating ribs 107, 108 are formed one step higher than the bottom surface defining the main from region A4 inside sandwiched by the pair of flow regulating ribs 107, 108. That is, steps are formed between the main flow region A4 inside sandwiched by the pair of flow regulating ribs 107, 108 and the sub-flow regions B4 outside the pair of flow regulating ribs 107, 108. Further, end portions of the flow regulating ribs 107, 108 in the ink flow direction are provided with small gaps 110 to 113 from the surrounding wall 98 in the extending direction thereof. Accordingly, the main flow region A4 and the sub-flow regions B4 are connected via the gaps 110 to 113.

The surrounding wall 98 has a shape such that the corners corresponding to the sub-flow regions B4 in a rectangular shape in a plan view are chamfered. Specifically, corner chamfered portions 98*a*, 98*b* are formed in a straight shape so that the surrounding wall 98 has a substantially hexagonal shape in a plan view. Further, the distance between the middle wall 35 and the damper wall 99 is smaller in the sub-flow regions B4 than in the main flow region A4. Thus, by the corner chamfered portions 98*a*, 98*b* being formed to be close to the flow regulating ribs 107, 108, the volumes of the sub-flow regions B4 become small, and channel cross-sectional areas orthogonal to a flow direction of the sub-flow regions B4 become small. Namely, the volume of the ink storage chamber 44 becomes smaller as compared to the case of being a rectangular shape from which the corners are not chamfered. Then a cylindrical portion 116 is provided to stand on the middle wall 35 on a right-front side of the surrounding wall 98. This cylindrical portion 116 forms a communication channel 116*a* in which the ink from one of the channels 36 flows, and this communication channel 116*a* is connected to the communication channel 56*a* (see FIG. 6) for the black ink in the lower tank part 32. Further, a cylindrical portion 117 is provided to stand on the middle wall 35 on a left-front side of the surrounding wall 98. This cylindrical portion 117 forms a communication channel 117*a* in which the ink from one of the channels 36 flows, and this communication channel 117*a* is connected to the communication channel 54*a* (see FIG. 6) for the cyan ink in the lower tank part 32. Further, also on a lower side of the ink lead-in area S1 (see FIG. 5) of the upper tank part 33, another resin film 115 is adhered to form the channels 36.

According to the above-explained structure, in the ink storage chamber 41 storing the cyan ink, the flow of ink from the ink inlet port 45 toward the ink outlet port 46 can be made smooth by the pair of flow regulating ribs 47, 48. The same applies to the ink storage chambers 42 to 44 storing the black, yellow, and magenta inks respectively. Further, in the sub-flow regions B1 in the ink storage chamber 41 storing the cyan ink, since the distances between the middle wall 34 and the damper wall 39 are small, the volume of the ink storage chamber 41 in the sub-flow regions B1 is small. Thus, when air flows in from the ink inlet port 45, the amount of air to remain in the sub-flow regions B1 is reduced. The same applies to the ink storage chambers 43, 44, storing the yellow and magenta inks respectively. Accordingly, the volumes of the air trap chambers 94 for capturing air flowing out of the ink storage chambers 41 to 44 are suppressed, and thereby a wasted ink amount in a purge operation to discharge ink from the nozzles of the ink-jet head 21 can be reduced.

Further, in the sub-flow regions B1 in the ink storage chamber 41 storing the cyan ink, the channel cross-sectional area is small because the distance between the middle wall 34 and the damper wall 39 is small. Accordingly, flow rates in the sub-flow regions B1, B3, B4 are accelerated. Therefore, even when a wrong kind of ink is supplied to the ink storage chamber 41, the ink remaining in the sub-flow regions B1 can be discharged smoothly by the purge operation, and thereby it becomes possible to recover quickly from a state that different kinds of inks are mixed. The same applies to the ink storage chambers 43, 44 storing the yellow and magenta inks respectively.

Furthermore, in the ink storage chamber 41 storing the cyan ink, the distance between the middle wall 34 and the damper wall 39 in the sub-flow regions B1 is larger than the distances between the upper ends of the flow regulating ribs 47, 48 and the damper wall 39. Then, when the damper wall 39 constructed of a resin film is adhered on the surrounding wall 38, if a small molten mass of the resin film drips on the sub-flow regions B1 it does not easily reach the middle wall 34. Therefore, it is prevented that the molten mass of the resin film reaches the middle wall 34 to make the vibration possible area of the damper wall 39 small, and thereby decrease of pressure fluctuation absorbing performance of the damper wall 39 can be prevented. The same applies to the ink storage chambers 42 to 44 storing the black, yellow, and magenta inks respectively.

Further, in the ink storage chamber 41 storing the cyan ink, since the surrounding wall 38 has a shape from which the corners corresponding to the sub-flow regions B1 are chamfered, the volumes of the sub-flow regions B1 become small. When air flows in from the ink inlet port 45, the amount of air remaining in the sub-flow regions B1 is reduced. The same applies to the ink storage chambers 42 to 44 storing the black, yellow, and magenta inks respectively. Accordingly, the volume of the air trap chamber 94 for capturing air flowing out of the ink storage chamber 41 can be suppressed, and a wasted ink amount required for discharging air in a purge operation to discharge ink from the nozzles of the ink-jet head 21 for maintenance can be reduced.

Furthermore, in the ink storage chamber 41 storing the cyan ink, corner portions of the surrounding wall 38 in a substantially rectangular shape in plan view are positions where two sides constituting the corner portions fix the damper wall 39 and have dynamic pressure absorbing performance that is originally poor. By removing them with the corner chamfered portions 38*a*, 38*b* to reduce the area of the damper wall 39 in the ink storage chamber 41, the time required for releasing an attaching pressure can be shortened while keeping the dynamic pressure absorbing performance as much as possible. The same applies to the ink storage chambers 42 to 44 storing the black, yellow, and magenta inks respectively. Therefore, even when the ink cartridges 9 are removed from the cartridge attaching part 8 just after attaching, dripping of ink from the ink inlet portion 27 of the cartridge attaching part 8 can be prevented.

Further, since the resin films forming the damper walls 39, 59, 79, 99 are adhered to the surrounding walls 38, 58, 78, 98 each in a rectangular shape in a state of being cut from a roll film by a film cutter as it is, processing after cutting is unnecessary, and increase of manufacturing steps can be prevented.

Second Embodiment

Figure 14:
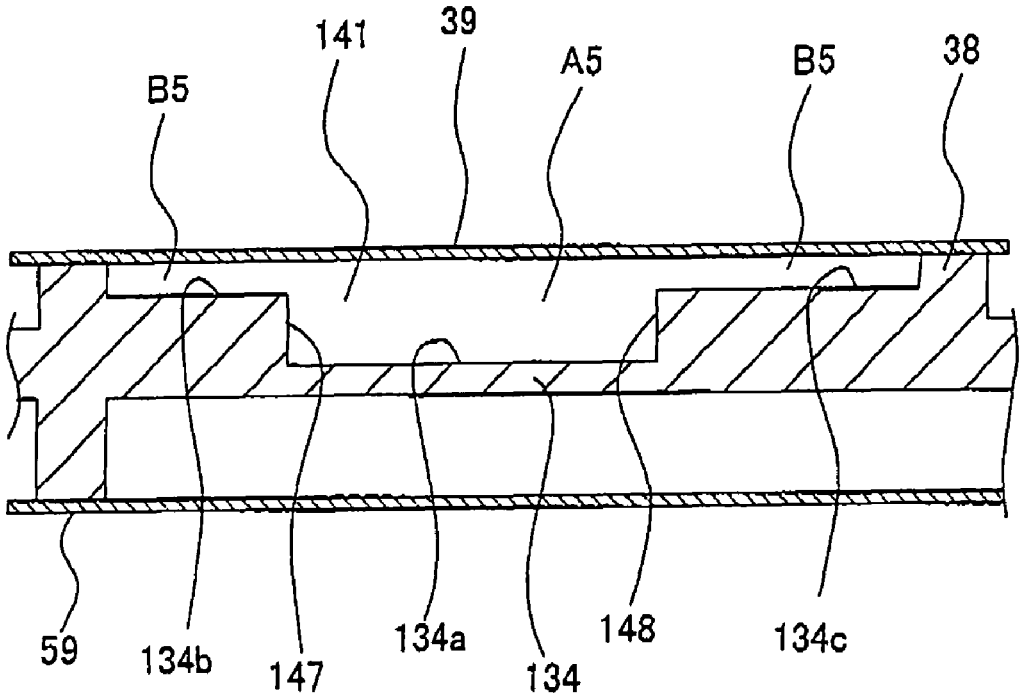
FIG. 14 is a view corresponding to FIG. 8 in a second embodiment of the present invention.

FIG. 14 is a view corresponding to FIG. 8 in a second embodiment of the present invention. As shown in FIG. 14, on an upper surface of a middle wall 134 in an ink storage chamber 141 storing the cyan ink, a pair of rising portions 147, 148 projecting from the middle wall 34 toward the damper wall 39 is provided, and the pair of rising portions 147, 148 extends substantially in parallel to a flow direction of ink from an ink inlet port toward an ink outlet port, similarly to the flow regulating ribs 47, 48 of the first embodiment. An inside space sandwiched by the pair of rising portions 147, 148 in the ink storage chamber 141 is a main flow region A5, and outside spaces between the rising portions 147, 148 and the surrounding wall 38 are sub-flow regions B5. A bottom surface 134*a* in the main flow region A5 is flat, and bottom surfaces 134*b*, 134*c* in the sub-flow regions B5 are also flat. Namely, no recess is provided in the bottom surfaces 134*b*, 134*c* in the sub-flow regions B5. Then distances betweens the middle wall 134 and the damper wall 39 in the sub-flow regions B5 are shorter than a distance between the middle wall 134 and the damper wall 39 in the main flow region A5. That is, the bottom surfaces defining the sub-flow regions B5 are formed one step higher than the bottom surface defining the main flow region A5. Thus the pair of rising portions 147, 148 is defined.

With the above structure, the volumes of the sub-flow regions B5 become further smaller, and also channel cross-sectional areas orthogonal to a flow direction of the sub-flow regions B5 become further smaller. Therefore, when air flows into the ink storage chamber 141, the amount of air remaining in the sub-flow regions B5 is reduced. Accordingly, the wasted ink amount in a purge operation can be reduced. Further, in the sub-flow regions B5, since the channel cross-sectional areas become further smaller by the distances between the middle wall 134 and the damper wall 39 becoming smaller, flow rates in the sub-flow regions B5 are accelerated further. Therefore, even when a wrong kind of ink is supplied to the ink storage chamber 141, the ink remaining in the sub-flow regions B5 can be discharged smoothly by the purge operation, and it becomes possible to recover quickly from a state that different kinds of inks are mixed. Note that the same applied to the ink storage chambers storing the yellow and magenta inks respectively. Further, the other structure is the same as in the above-explained first embodiment, and hence explanation thereof is omitted.

Third Embodiment

Figure 15:
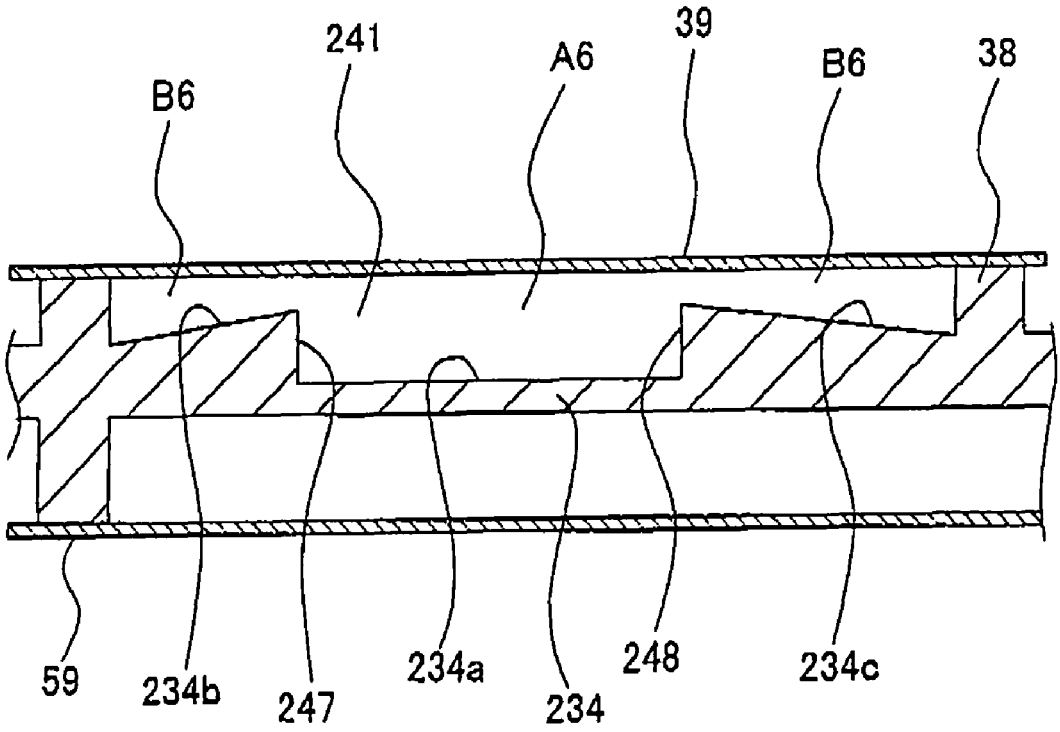
FIG. 15 is a view corresponding to FIG. 8 in a third embodiment of the present invention.

FIG. 15 is a view corresponding to FIG. 8 in a third embodiment of the present invention. As shown in FIG. 15, on an upper surface of a middle wall 234 in an ink storage chamber 241 storing the cyan ink, a pair of rising portions 247, 248 projecting from the middle wall 234 toward the damper wall 39 is provided, and the pair of rising portions 247, 248 extends substantially in parallel to a flow direction of ink from an ink inlet port toward an ink outlet port, similarly to the flow regulating ribs 47, 48 of the first embodiment. An inside space sandwiched by the pair of rising portions 247, 248 is a main flow region A6, and outside spaces between the rising portions 247, 248 and the surrounding wall 38 are sub-flow regions B6. A bottom surface 234*a* in the main flow region A6 is flat, and bottom surfaces 234*b*, 234*c* in the sub-flow regions B6 inclines from the rising portions 247, 248 toward the surrounding wall 38 so that distances thereof from the damper wall 39 increase gradually. Then the maximum distance between the middle wall 134 and the damper wall 39 in the sub-flow regions B6 is smaller than a distance between the middle wall 134 and the damper wall 39 in the main flow region A6. That is, the bottom surfaces defining the sub-flow regions B6 are formed one step higher than the bottom surface defining the main flow region A6. Thus the pair of rising portions 247, 248 is defined.

With the above structure, it is possible to make the volumes of the sub-flow regions B6 small as much as possible while preventing a molten mass of the resin film forming the damper wall 39 from reaching the middle wall 134. Note that the same applies to the ink storage chambers storing the yellow and magenta inks respectively. Further, the other structure is the same as in the above-described first embodiment, and hence explanation thereof is omitted.

In the above embodiments, in the ink storage chamber storing the black ink, the steps provided in the ink storage chambers storing the color inks are not formed. However, steps like those shown in the above embodiments may be formed in the ink storage chamber storing the black ink. Further, in the above embodiments, in the ink storage chamber storing the black ink, the gaps provided in the ink storage chambers storing the color inks are not formed. The present invention is not limited to this. There may be formed gaps in the ink storage chamber storing the black ink, and conversely, there may be no gaps formed in the ink storage chambers storing the color inks.

Note that in the above embodiments, the inks are supplied to the ink-jet head via the ink supply tubes from the ink cartridges mounted in the cartridge attaching part. That is, a tube supply method is adopted. However, the present invention is not limited to this. The present invention can be applied also to an ink-jet printer in which inks are supplied by a so-called station supply method.

Figure 16:
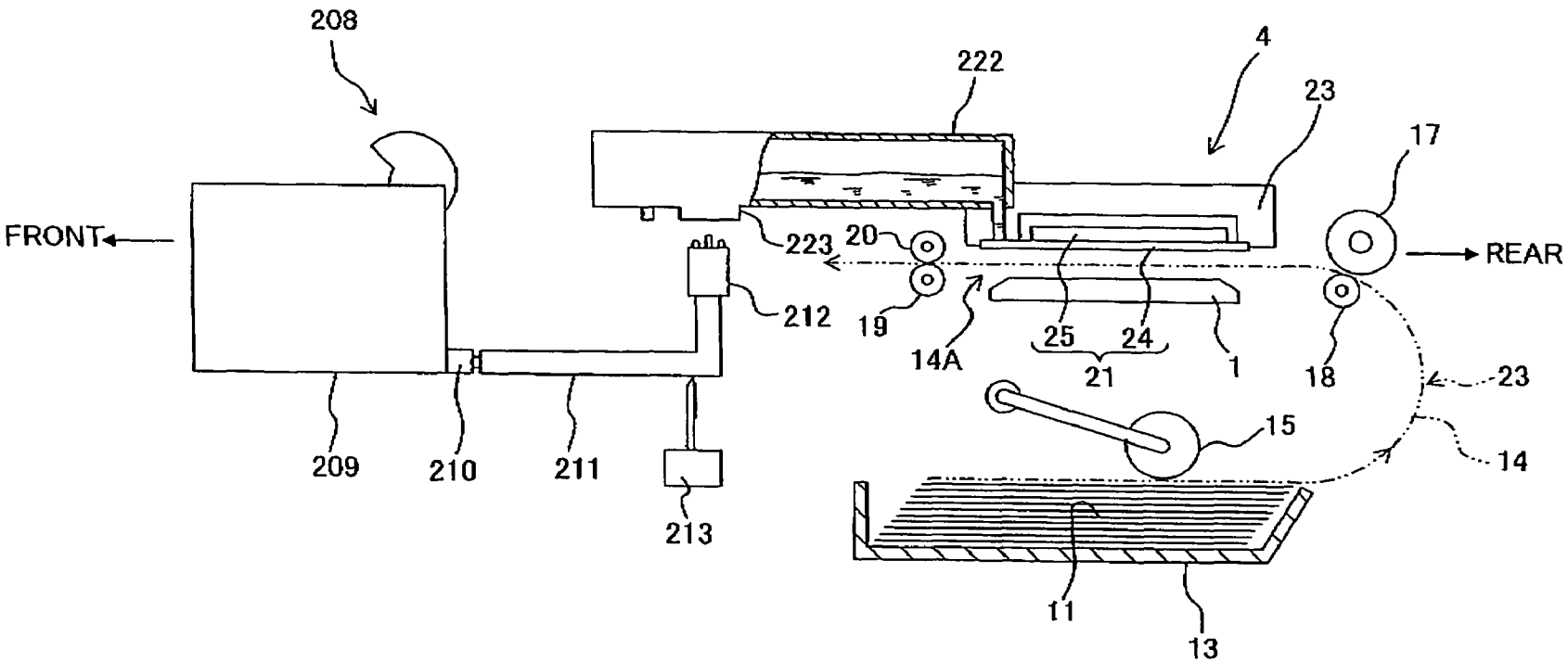
FIG. 16 is a view corresponding to FIG. 2 regarding an ink-jet printer of a station supply method.

For example, on one ends (ink refilling position) of the guide rails 2, 3, as shown in FIG. 16, there is provided a main tank mounting part 208 on which a main tank 209 is mounted. Further, the head unit 4 moving along the guide rails 2, 3 has a sub-tank 222, where an ink can be refilled from the main tank 209 to the sub tank 222 when the head unit 4 is located at the ink refilling position. Specifically, as shown in FIG. 16, to an ink supply port 210 provided in the vicinity of a bottom portion of the main tank 209, there is attached a joint valve 212 which is joined to a refill port valve 223 provided on the sub tank 222 via a tube 211 disposed on the main tank 209. The joint valve 212 is moved vertically by a lifting mechanism 213. Therefore, while the head unit 4 is located at the ink refilling position, when the joint valve 212 is lifted by this lifting mechanism 213 the joint valve 212 and the refill port valve 223 engage with each other, and they communicate with each other. As a result, the main tank 209 and the sub-tank 222 communicate with each other via the valves 212, 223. Accordingly, the ink in the main tank 209 is supplied to the sub-tank 222. The present invention can also be applied to such a sub-tank 222.

Although the present invention is applied to an ink-jet head in the above-described respective embodiments, it should be noted that the invention may be applied to, for example, a liquid jetting apparatus used for an apparatus producing a color filter for a liquid display device by jetting liquid other than ink, for example coloring liquid, an apparatus forming an electrical wiring by jetting conductive liquid, or the like.

As described above, a liquid jetting apparatus according to the present invention has an excellent effect that a wasted ink amount during purging is reduced, and the apparatus is beneficial when applied widely to an ink-jet printer or the like which can exhibit the meaning of this effect.

What is claimed is:

1. A liquid-droplet jetting apparatus which jets droplets of a liquid comprising:

a liquid supply source supplying the liquid;

a liquid-droplet jetting head having a plurality of nozzles; and a liquid storage chamber storing the liquid supplied from the liquid supply source and including:

a liquid inlet port through which the liquid supplied from the liquid supply source flows in;

a liquid outlet port through which liquid flows out to the liquid-droplet jetting head;

a pair of walls substantially in parallel to a flow direction of the liquid from the liquid inlet port toward the liquid outlet port and facing each other vertically with a distance therebetween; and a surrounding wall surrounding a circumference of a space between the pair of walls;

wherein one wall of the pair of walls is a damper wall having flexibility;

wherein the other wall of the pair of walls defines a main flow region and sub-flow regions, the main flow region in which the liquid flows from the liquid inlet port to the liquid outlet port and which extends substantially in parallel to the flow direction, and the sub-flow regions being sandwiched by the main flow region and the surrounding wall on both sides of the flow direction of the main flow region and being formed higher toward the one wall, of the pair of walls, than the main flow region; and wherein the sub-flow regions are extended, in an orthogonal direction substantially orthogonal to the flow direction, so that the sub-flow regions are continued to the surrounding wall.

2. The liquid-droplet jetting apparatus according to claim 1;

wherein the damper wall is formed of a resin film adhered on the surrounding wall; and wherein a distance between the other wall, of the pair of walls, and the damper wall in the sub-flow regions is larger in a vicinity of the surrounding wall than in a vicinity of borders between the main flow region and the sub-flow regions.

3. The liquid-droplet jetting apparatus according to claim 2;

wherein a pair of flow regulating ribs projecting toward the damper wall from the other wall, of the pair of walls, and extending in parallel to the flow direction is formed on the borders between the main flow region and the sub-flow regions.

4. The liquid-droplet jetting apparatus according to claim 2;

wherein a surface of the other wall, of the pair of walls, in the sub-flow regions facing the damper wall inclines so that a distance between the surface of the other wall and the damper wall is increased gradually from the borders between the main flow region and the sub-flow regions toward the surrounding wall.

5. The liquid-droplet jetting apparatus according to claim 2;

wherein the damper wall is formed of a material selected from a group consisting of polyethylene terephthalate, nylon, and polypropylene.

6. The liquid-droplet jetting apparatus according to claim 3;

wherein a distance between the damper wall and a surface, of each of the flow regulating ribs, facing the damper wall is shorter than a distance between the damper wall and a surface of the other wall, of the pair of walls, facing the damper wall in the vicinity of the surrounding wall in the sub-flow regions.

7. The liquid-droplet jetting apparatus according to claim 3;

wherein gaps are defined between the surrounding wall and both ends of the flow regulating ribs in the flow direction.

8. The liquid-droplet jetting apparatus according to claim 7;

wherein the liquid storage chamber is formed as a plurality of individual liquid storage chambers stacked vertically, and color inks are stored as the liquid in the individual liquid storage chambers respectively, the color inks not being a black ink.

9. The liquid-droplet jetting apparatus according to claim 1;

wherein the liquid supply source has a liquid storage chamber and a liquid outlet portion;

wherein the liquid-droplet jetting apparatus further comprises an attaching part which has a liquid inlet portion coupled to the liquid outlet portion of the liquid supply source, and to which the liquid supply source is attached detachably, and a communication channel communicating the liquid inlet portion and the liquid storage chamber; and wherein the surrounding wall has a substantially rectangular shape in which one of corners is chamfered.

10. The liquid-droplet jetting apparatus according to claim 9;

wherein the other wall, of the pair of walls, has a pair of flow regulating ribs projecting toward the damper wall and extending substantially in parallel to the flow direction with a distance from the damper wall, and arranged on borders between the main flow region and the sub-flow regions; and wherein the surrounding wall has a shape in which corner portions corresponding to the sub regions are chamfered.

11. The liquid-droplet jetting apparatus according to claim 9;

wherein the damper wall is formed by adhering a resin film of a rectangular shape on the surrounding wall.

12. The liquid-droplet jetting apparatus according to claim 9;

wherein the liquid storage chamber is arranged at a position higher than the liquid inlet portion of the attaching part.

* * * * *